US009347461B2

(12) United States Patent
Shiraichi et al.

(10) Patent No.: US 9,347,461 B2
(45) Date of Patent: May 24, 2016

(54) CROSS-FLOW FAN, MOLDING DIE, AND FLUID FEEDER

(75) Inventors: Yukishige Shiraichi, Osaka (JP); Masaki Ohtsuka, Osaka (JP)

(73) Assignee: SHARP KABUSHIKI KAISHA, Osaka-Shi (JP)

( * ) Notice: Subject to any disclaimer, the term of this patent is extended or adjusted under 35 U.S.C. 154(b) by 721 days.

(21) Appl. No.: 13/395,225

(22) PCT Filed: Sep. 7, 2010

(86) PCT No.: PCT/JP2010/065302

§ 371 (c)(1),
(2), (4) Date: Mar. 9, 2012

(87) PCT Pub. No.: WO2011/030749

PCT Pub. Date: Mar. 17, 2011

(65) Prior Publication Data

US 2012/0177477 A1 Jul. 12, 2012

(30) Foreign Application Priority Data

Sep. 11, 2009 (JP) ..... 2009-210465

(51) Int. Cl.

*F04D 23/00* (2006.01)
*F04D 29/28* (2006.01)
*F04D 17/04* (2006.01)
(Continued)

(52) U.S. Cl.

CPC ..... *F04D 29/283* (2013.01); *F04D 17/04* (2013.01); *F04D 29/666* (2013.01)

(58) Field of Classification Search

CPC ..... F04D 17/04; F04D 29/283; F04D 29/666; F04D 29/281; F04D 29/282; F04D 29/663

USPC ..... 415/53.1; 416/178, 187, 198 R, 200 R, 416/203

See application file for complete search history.

(56) References Cited

U.S. PATENT DOCUMENTS

| | | | | |
|---|---|---|---|---|
| 6,158,954 | A * | 12/2000 | Nabeshima et al. | 415/53.1 |
| 2007/0212211 | A1 * | 9/2007 | Chiyoda et al. | 415/53.1 |
| 2009/0290986 | A1 | 11/2009 | Haraguchi et al. | |

FOREIGN PATENT DOCUMENTS

| | | | |
|---|---|---|---|
| CN | 1230636 | A | 10/1999 |
| CN | 100552230 | C * | 10/2009 |
| JP | 48-84307 | | 11/1973 |

(Continued)

*Primary Examiner* — Craig Kim
*Assistant Examiner* — Alexander White
(74) *Attorney, Agent, or Firm* — Birch, Stewart, Kolasch & Birch, LLP

(57) ABSTRACT

Disclosed is a cross-flow fan where an inner diameter (d) and an outer diameter (D) of a fan blade meet the relationship expressed by $0.55 \leq d/D \leq 0.95$. In cross-flow fan, (N) representing number of fan blades, a chord length (L) and outer diameter (D) of fan blades, and (M) representing number of blade wheels meet the relationships expressed by of $0.6 \leq L/(\pi D/N) \leq 2.8$ and $0.15 \leq \pi D/(N \times M) \leq 3.77$. A plurality of blade wheels are stacked on each other in a manner that a displacement angle (θ) is generated within the range of $(1.2 \times 360°/(N \times M)) \leq \theta \leq (360°/N)$ between adjacent blade wheels. The displacement angle (θ) is set so that the overlapping number of fan blades having an equal installation angle is at most 5% of N×M representing a total number of fan blades. The present invention can provide a cross-flow fan that can succeed in noise reduction, a molding die used to produce the cross-flow fan, and a fluid feeder equipped with the cross-flow fan.

7 Claims, 15 Drawing Sheets

(51) Int. Cl.
*F04D 29/66* (2006.01)
*B29C 45/00* (2006.01)

(56) References Cited

FOREIGN PATENT DOCUMENTS

| | | | | |
|---|---|---|---|---|
| JP | 6-173886 | A | | 6/1994 |
| JP | 2758800 | B2 | * | 5/1998 |
| JP | 2000-297946 | A | | 10/2000 |
| JP | 2003-269363 | A | | 9/2003 |
| JP | 2006-118496 | A | | 5/2006 |
| JP | 2007-92594 | A | | 4/2007 |
| JP | 2007-170308 | A | | 7/2007 |
| JP | 2007170308 | A | * | 7/2007 |
| WO | WO 2004/029463 | A1 | | 4/2004 |

* cited by examiner

FIG.13

| DISPLACEMENT ANGLE (° ) | OVERLAPPING NUMBER (NUMBER) | RATIO OF OVERLAPPING NUMBER WITH RESPECT TO TOTAL NUMBER OF FAN BLADES (%) | NOISE VALUE (dB(A)) |
|---|---|---|---|
| 0.4 | 0 | 0 | 54.6 |
| 1.0 | 10 | 2.4 | 51.2 |
| 1.9 | 24 | 5.9 | 50.3 |
| 2.4 | 18 | 4.4 | 49.9 |
| 2.8 | 38 | 9.2 | 50.3 |
| 3.6 | 10 | 2.4 | 49.8 |
| 5.3 | 0 | 0 | 49.8 |
| 5.9 | 64 | 15.6 | 52.3 |
| 6.1 | 20 | 4.8 | 49.9 |
| 7.2 | 12 | 2.9 | 49.9 |

CROSS-FLOW FAN, MOLDING DIE, AND FLUID FEEDER

TECHNICAL FIELD

The present invention generally relates to a cross-flow fan, a molding die, and a fluid feeder, more particularly to a cross-flow fan, a molding die used to produce the cross-flow fan, and a fluid feeder equipped with the cross-flow fan, for example, air conditioner, air purifier, humidifier, dehumidifier, electric fan, fan heater, cooling device, or ventilating device.

BACKGROUND ART

Japanese Patent Laying-Open No. 2006-118496 discloses a conventional cross-flow fan designed with an attempt to reduce noises caused by fluid oscillation and to improve an air-blow performance (PTL 1). The cross-flow fan disclosed in PTL 1 is provided with at least 34 blades to at most 36 blades. The blades respectively have random pitches (angles), and the following relationship is met; 1.0 (deg)≤Pmax−Pmin ≤2.5 (deg), where Pmax is the largest pitch and Pmin is the smallest pitch.

Japanese Patent Laying-Open No. 2003-269363 discloses a tangential fan blade wheel designed with an attempt to effectively reduce discrete frequency noises (PTL 2). According to the tangential fan blade wheel disclosed in PTL 2, plural blades are divided into even-numbered groups having an equal number of blades. The tangential fan blade wheel is configured to have a pitch difference angle $\epsilon$ meeting the relationship of $\beta=\alpha+\gamma$ and $\gamma+\alpha-\epsilon$, where $\alpha$ is a virtual average pitch angle, $\beta$ is a pitch angle between the blades in one of the adjacent groups, and $\gamma$ is a pitch angle between the blades in the other group. The tangential fan blade wheel is structurally characterized in that respective blocks of the blade wheel are axially displaced by an angle $\delta$ and joined with one another to minimize the synthesized sound pressure of an NZr component wave in each block.

CITATION LIST

Patent Literature

PTL 1: Japanese Patent Laying-Open No. 2006-118496
PTL 2: Japanese Patent Laying-Open No. 2003-269363

SUMMARY OF INVENTION

Technical Problem

The conventional cross-flow fans so far disclosed, which are used in, for example, air conditioners and air purifiers, are variously devised to reduce noises and achieve a higher operating efficiency. Particularly, these fans were invented to provide solutions for any abnormal sounds auditorily offensive, for example, short-wavelength noises, generally called blade passing sounds (whistling sounds) and noises generated when an inter-blade airflow is disturbed (generally called surging sounds).

The cross-flow fan disclosed in PTL 1 is designed with an attempt to control the occurrence of any abnormal sounds by devising blade installation pitches in the direction of rotation of the fan. The tangential fan blade wheel disclosed in PTL 2 is designed with an attempt to control the occurrence of any abnormal sounds by devising the arrangement of blades in the direction of rotation of the fan and the displacement angle between blocks of the blade wheel.

When a cross-flow fan configured to blow air with a higher air flow rate is desirably obtained, the cross-flow fan needs to be formed in a larger diameter. On the other hand, a ratio between inner and outer diameters of the fan must stay within a required numeral range because the lengths of blades are subject to certain restrictions to avoid deterioration of an air-blowing efficiency. Another requirement for preventing the air-blowing efficiency from deteriorating is that a ratio between the blade length and inter-blade interval must stay within a required numeral range.

These requirements inevitably increase the number of blades in the direction of rotation as the outer diameter of the fan is larger. When the number of blades is thus increased in the direction of rotation, a more refined arrangement is demanded to control the blade passing sounds (whistling sounds). Particularly because of a difficulty in finding an optimal value of the displacement angle between the adjacent blade wheels, it is necessary to find a novel solution for solving this problem.

The present invention was accomplished to overcome these conventional technical disadvantages. The present invention provides a cross-flow fan that can succeed in noise reduction, a molding die used to produce the cross-flow fan, and a fluid feeder equipped with the cross-flow fan.

Solution to Problem

A cross-flow fan according to an aspect of the present invention includes a blade wheel having: a plurality of blades arranged in a circumferential direction centered on a predefined axis with randomly different intervals therebetween; and a support unit connected to the plurality of blades to support the blades in a unified manner. The cross-flow fan is formed such that a plurality of the blade wheels are formed in a manner that the blades are all uniformly arranged, the plurality of the blade wheels being stacked on each other along an axial direction of the predefined axis. The cross-flow fan is formed such that an inner diameter d and an outer diameter D of the blades meet the relationship expressed by $0.55 \leq d/D \leq 0.95$. The cross-flow fan is formed such that N representing number of the blades, a chord length L of the blades, outer diameter D of the blades, and M representing number of the blade wheels meet the relationships expressed by $0.6 \leq L/(\pi D/N) \leq 2.8$ and $0.15 \leq \pi D/(N \times M) \leq 3.77$. The plurality of the blade wheels are stacked on each other in a manner that a displacement angle $\theta$ is generated within the range of $(1.2 \times 360°/(N \times M)) \leq \theta \leq (360°/N)$ between the blade wheels adjacent to each other when viewed from the axial direction of the predefined axis. Displacement angle $\theta$ is defined such that the overlapping number of the blades having an equal installation angle in all of the blades is at most 5% of the N×M blades in total.

Regarding the term "displacement angle", upon focusing on an arbitrary one of the blade wheels (for example, number j) and another one of the blade wheels adjacent thereto (for example, number j+1), the displacement angle is defined as a predefined angle at which the blade wheel (j+1) is displaced relative to the blade wheel (j) in the circumferential direction centered on the predefined axis from a position where all of the blades of the blade wheel (j) and the blade wheel (j+1) are overlapping one another in the axial direction of the predefined axis.

Regarding the term "overlapping number", the blade having an installation angle around the predefined axis equal to angles of the other blades is identified in each of the N×M blades in total, and a total number of the identified blades is defined as the "overlapping number".

According to the cross-flow fan thus structured, the overlapping number of the blades having an equal installation angle is at most 5% of the N×M blades in total, narrow-band noises resulting from the blade passing sounds (nZ sounds) can be effectively controlled. This succeeds in reducing noises generated by the rotation of the cross-flow fan.

Preferably, the cross-flow fan meets the relationship expressed by $0.05(\pi D/N) \leq |Cn-(\pi D/N)| \leq 0.24(\pi D/N)$ between arbitrary adjacent ones of the blades, where Cn (n=1, 2, . . . , N−1, N) is the length of a circular arc centered on the predefined axis and connecting outer peripheral ends of the adjacent blades on a plane orthogonal to the predefined axis.

According to the cross-flow fan thus structured, $(\pi D/N)$ represents inter-blade intervals of the blades equally spaced around the predefined axis, and $|Cn-(\pi D/N)|$ represents a degree of variability of the inter-blade intervals as compared to the structure where the blades are equally spaced around the predefined axis.

In the presence of any inter-blade intervals where $|Cn-(\pi D/N)|$ is smaller than 5% of $(\pi D/N)$, there may be an overly large increase of the blade passing sounds because the blades are almost equally spaced. In the presence of the inter-blade intervals where $|Cn-(\pi D/N)|$ is larger than 24% of $(\pi D/N)$, some of the blades are too distantly spaced from each other around the predefined axis, and large separation sounds may be generated there. According to the present invention, the relationship expressed by $0.05(\pi D/N) \leq |Cn-(\pi D/N)| \leq 0.24(\pi D/N)$ is met, the blade passing sounds and the separation sounds can be effectively controlled.

The cross-flow fan preferably further meets the relationship expressed by $0.68 \leq d/D \leq 0.86$. The cross-flow fan preferably further meets the relationship expressed by $1.4 \leq L/(\pi D/N) \leq 2.1$. The cross-flow fan preferably further meets the relationship expressed by $0.43 \leq \pi D/(N \times M) \leq 2.83$.

The cross-flow fan thus structured can ensure a sufficiently high air-blow performance and effectively reduce noises generated by the rotation of the cross-flow fan.

A cross-flow fan according to another aspect of the present invention includes a blade wheel having: a plurality of blades arranged in a circumferential direction centered on a predefined axis with randomly different intervals therebetween; and a support unit connected to the plurality of blades to support the blades in a unified manner. The cross-flow fan is formed such that a plurality of the blade wheels are formed in a manner that the blades are all uniformly arranged, the plurality of the blade wheels being stacked on each other along an axial direction of the predefined axis. The cross-flow fan is formed such that an inner diameter d and an outer diameter D of the blades meet the relationship expressed by $0.68 \leq d/D \leq 0.86$. The cross-flow fan is formed such that that N representing number of the blades, a chord length L of the blades, outer diameter D of the blades, and M representing number of the blade wheels meet the relationships expressed by $1.4 \leq L/(\pi D/N) \leq 2.1$ and $0.43 \leq \pi D/(N \times M) \leq 2.83$.

The cross-flow fan thus structured can ensure a sufficiently high air-blow performance and effectively reduce noises generated by the rotation of the cross-flow fan.

Preferably, the cross-flow fan is produced from resin. According to the cross-flow fan thus produced, the cross-flow fan produced from resin being lightweight and having a remarkable strength can be realized.

A molding die according to the present invention is used to mold any of the cross-flow fans described so far. When the molding die thus structured is used, a cross-flow fan made of resin and superior in quietness during rotation can be produced.

A fluid feeder according to the present invention is equipped with any of the cross-flow fans described so far and an air blower including a drive motor coupled with the cross-flow fan to rotate the plurality of blades. The fluid feeder thus structured can enhance quietness during an operation while maintaining a remarkable air-blowing performance.

Advantageous Effects of Invention

As described so far, the present invention can provide a cross-flow fan that can succeed in noise reduction, a molding die used to produce the cross-flow fan, and a fluid feeder equipped with the cross-flow fan.

BRIEF DESCRIPTION OF DRAWINGS

FIG. 13 is a table reciting respective overlapping numbers of fan blades at different displacement angles, ratios of overlapping numbers, and noise values.

DESCRIPTION OF EMBODIMENTS

Figure 1:
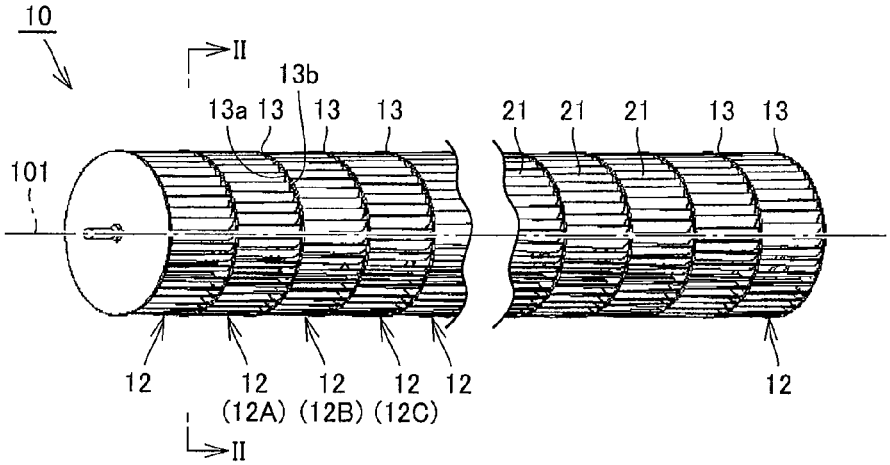
FIG. 1 is a side view of a cross-flow fan according to an embodiment 1 of the present invention.

Hereinafter, embodiments of the present invention are described in detail referring to the accompanied drawings. In the drawings used in the description given below, any structural elements exactly the same or almost the same are illustrated with the same reference numerals.

Embodiment 1

[Description of Basic Structure of Cross-Flow Fan]

Figure 2:
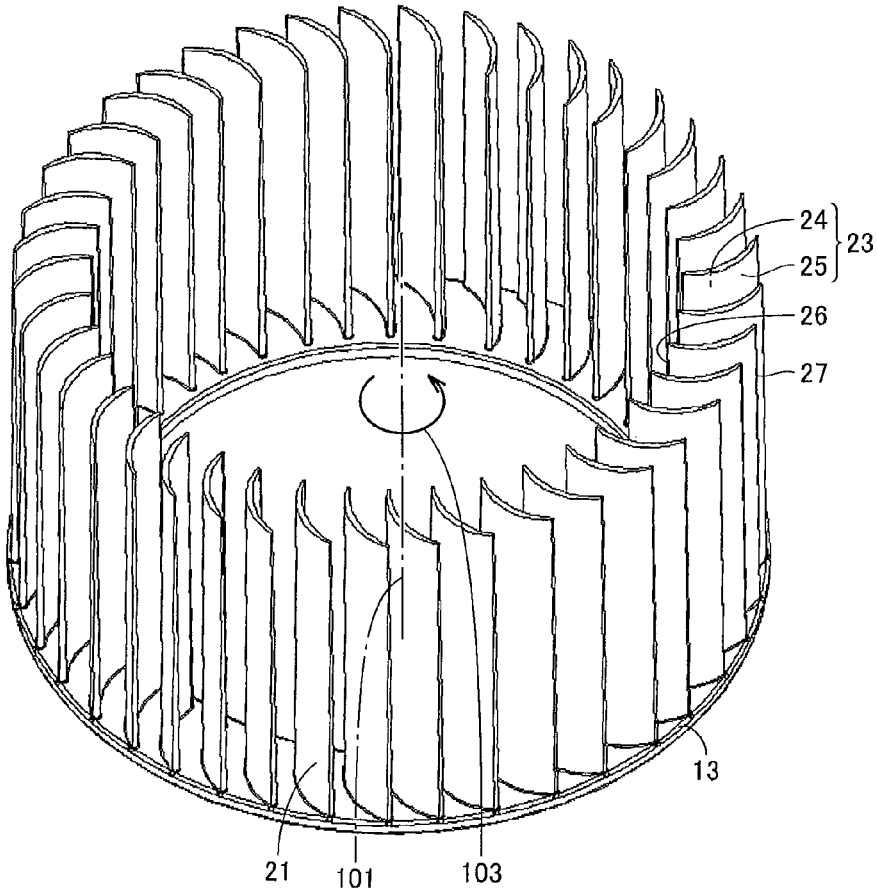
FIG. 2 is a perspective view of the cross-flow fan along II-II line illustrated in FIG. 1.
Figure 3:
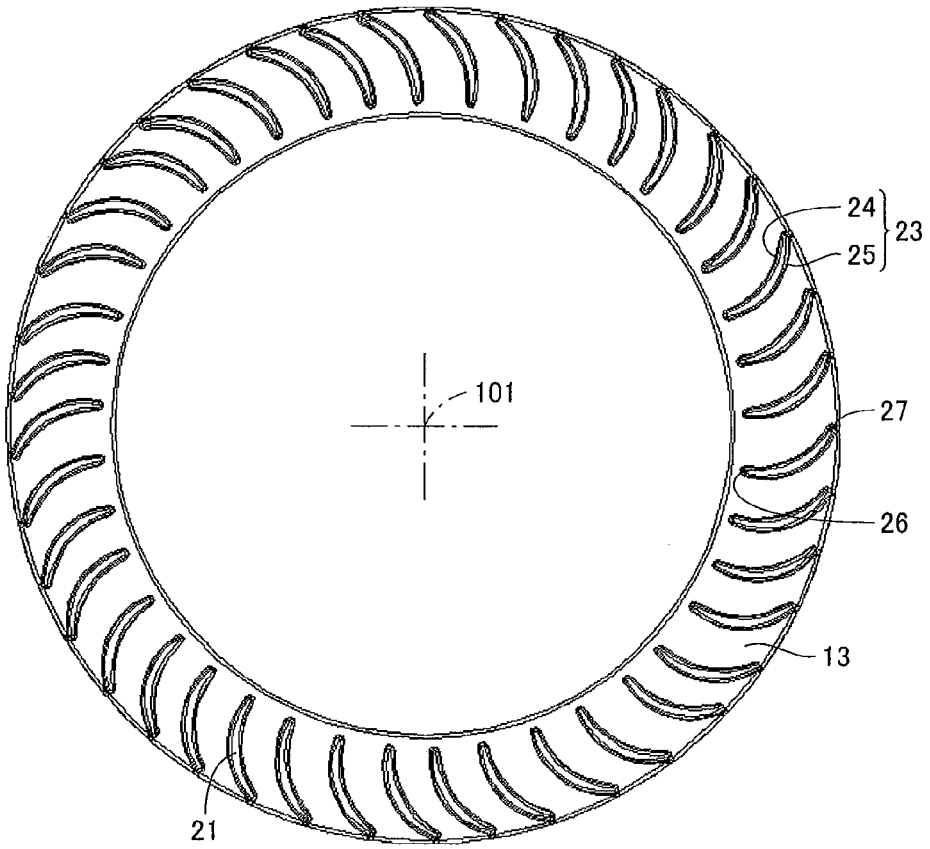
FIG. 3 is a sectional view of the cross-flow fan along line illustrated in FIG. 1.

FIG. 1 is a side view of a cross-flow fan according to an embodiment 1 of the present invention. FIG. 2 is a perspective view of the cross-flow fan along II-II line illustrated in FIG. 1. FIG. 3 is a sectional view of the cross-flow fan along II-II line illustrated in FIG. 1.

Referring to FIGS. 1 to 3, a cross-flow fan 10 is structured such that a plurality of blade wheels 12 stacked on one another in an axial direction of a center axis 101 are combined. Blade wheels 12 each has a plurality of fan blades 21 and an outer peripheral frame 13.

Plural fan blades 21 are spaced from one another at intervals in a circumferential direction centered on virtual center axis 101. The overall external appearance of cross-flow fan 10 is a substantially cylindrical shape, and plural fan blades 21 are arranged on a side surface of the substantially cylindrical shape. Cross-flow fan 10 is produced from resin in an integral structure. Cross-flow fan 10 is rotated in a direction illustrated in FIG. 2 with an arrow 103 around center axis 101 as a rotational center.

Cross-flow fan 10 sends air in a direction orthogonal to center axis 101 by rotating plural fan blades 21. Observing the operation of cross-flow fan 10 from an axial direction of center axis 101, air is sucked from an external space on one side relative to center axis 101 into an internal space of the fan and then blown out into an external space on the other side relative to center axis 101. Cross-flow fan 10 forms an airflow travelling in a direction intersecting with center axis 101 in a plane orthogonal to center axis 101. Cross-flow fan 10 forms a flat flow of the blown-out air in parallel with center axis 101.

Cross-flow fan 10 is used at the number of rotations in the range of low Reynolds numbers applied to fans such as home-use electric devices.

Outer peripheral frame 13 has a ring shape centered on center axis 101 and extending in an annular shape. Outer peripheral frame 13 has an end surface 13*a* and an end surface 13*b*. End surface 13*a* is formed in a direction along the axial direction of center axis 101. End surface 13*b* is formed on the back side of end surface 13*a* in the other direction along the axial direction of center axis 101.

Outer peripheral frame 13 is interposed between adjacent blade wheels 12 in the axial direction of center axis 101.

Focusing on blade wheels 12A and 12B adjacent to each other illustrated in FIG. 1, plural fan blades 21 provided in blade wheel 12A are connected to end surface 13*a* and formed so as to extend in a plate-like shape along the axial direction of center axis 101, while plural fan blades 21 provided in blade wheel 12B are connected to end surface 13*b* and formed so as to extend in a plate-like shape along the axial direction of center axis 101.

All of plural fan blades 21 have an equal shape. Upon describing the shape in detail, each of fan blades 21 has an inner peripheral portion 26 and an outer peripheral portion 27. Inner peripheral portion 26 is provided on the inner peripheral side of fan blade 21. Outer peripheral portion 27 is provided on the outer peripheral side of fan blade 21. Fan blade 21 is formed with a tilt in the circumferential direction centered on center axis 101 from inner peripheral portion 26 toward outer peripheral portion 27 thereof. Fan blade 21 is also formed with a tilt in the direction of rotation of cross-flow fan 10 from inner peripheral portion 26 toward outer peripheral portion 27 thereof.

Fan blades 21 each has a blade surface 23 including a positive pressure surface 24 and a negative pressure surface 25. Positive pressure surface 24 is formed on the side of the direction of rotation of cross-flow fan 10, and negative pressure surface 25 is formed on the back side of positive pressure surface 24. During the rotation of cross-flow fan 10, a pressure distribution in which the pressure is relatively large on positive pressure surface 24 and relatively small on negative pressure surface 25 is generated alongside an airflow generated on blade surface 23. Fan blade 21 has an overall shape curved between inner peripheral portion 26 and outer peripheral portion 27 where the side of positive pressure surface 24 is has a concave shape and the side of negative pressure surface 25 has a convex shape.

Fan blades 21 are formed in a manner that shapes thereof in cross section are all equal even when cut across at any position in the axial direction of center axis 101, and the shapes in cross section thereof have a small thickness. Further, fan blades 21 are each formed in a substantially equal thickness (a length between positive pressure surface 24 and negative pressure surface 25) between inner peripheral portion 26 and outer peripheral portion 27.

Plural fan blades 21 are arranged at random pitches in the circumferential direction centered on center axis 101. The random pitches are obtained by locating plural fan blades 21 at unequal intervals in accordance with random-number normal distribution. Plural blade wheels 12 are formed in a manner that fan blades 21 are all uniformly arranged. More specifically describing the arrangement, intervals between plural fan blades 21 and the order of fan blades 21 arranged with the intervals therebetween are all uniform in all of blade wheels 12.

[Description of Numeral Ranges Relating to Blade Fans and Blade Wheels]

In cross-flow fan 10 according to the present embodiment, N represents the number of fan blades 21 provided in each blade wheel 12, and M represents the number of blade wheels 12 stacked on one another in the axial direction of center axis 101.

Figure 4:
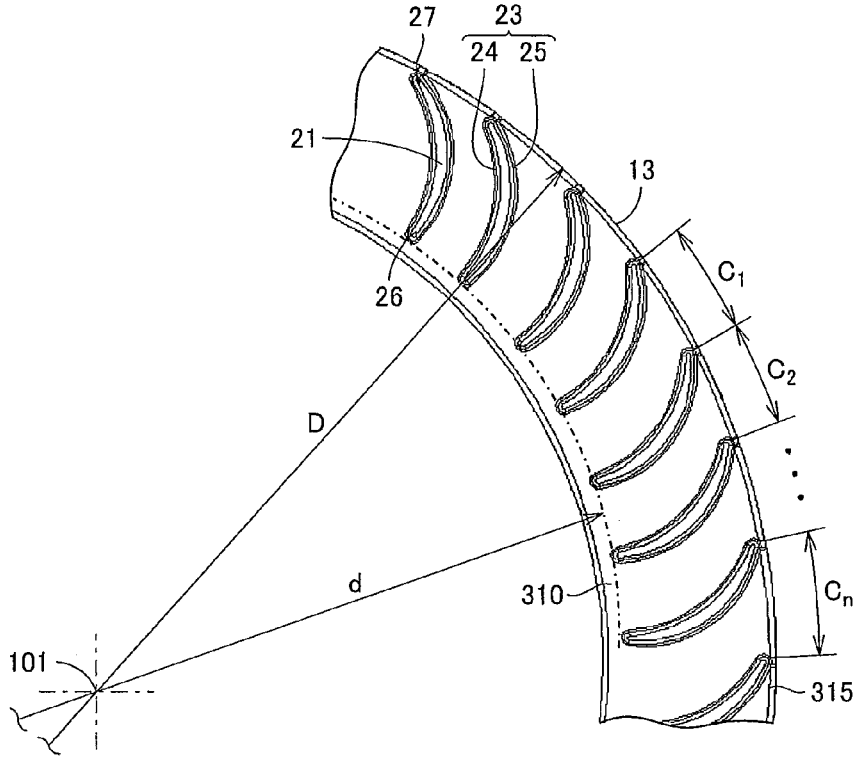
FIG. 4 is an enlarged sectional view of a part of the cross-flow fan illustrated in FIG. 3.
Figure 5:
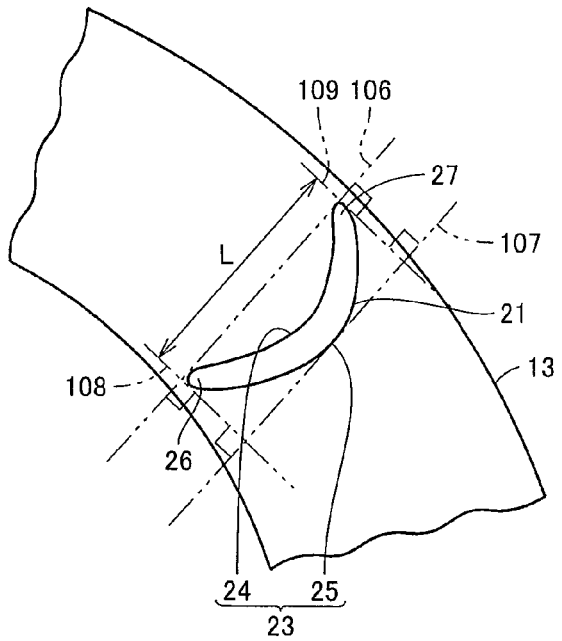
FIG. 5 is a sectional view of a fan blade of the cross-flow fan illustrated in FIG. 3.

FIG. 4 is an enlarged sectional view of a part of the cross-flow fan illustrated in FIG. 3. FIG. 5 is a sectional view of a fan blade of the cross-flow fan illustrated in FIG. 3.

FIG. 4 illustrates an inscribed circle 310 centered on center axis 101 and inscribing plural fan blades 21 arranged in the circumferential direction, and a circumscribed circle 315 centered on center axis 101 and circumscribing plural fan blades 21 arranged in the circumferential direction. Cross-flow fan 10 according to the present embodiment is formed such that fan blades 21 have an inner diameter d represented by the diameter of inscribed circle 310 and an outer diameter D represented by the diameter of circumscribed circle 315.

On a plane orthogonal to center axis 101 illustrated in FIG. 4, a circular arc centered on center axis 101 and connecting outer peripheral ends of adjacent fan blades 21 has a length Cn. More specifically, the length Cn represents a length of the circular arc of circumscribed circle 315 between a point of contact of fan blade 21 with circumscribed circle 315 and a point of contact of another fan blade 21 with circumscribed circle 315 and adjacent to fan blade 21, wherein n takes values 1, 2, . . . , N−1, N (number of fan blades 21), and Cn represents a circular arc length at each position between adjacent fan blades 21.

According to the present embodiment in which plural blade wheels 12 are formed in a manner that fan blades 21 are all uniformly arranged, values of Cn (n=1, 2, . . . , N−1, N) in blade wheels 12 are all equal.

FIG. 5 illustrates a straight line 106 contacting an end portion of inner peripheral portion 26 and an end portion of outer peripheral portion 27 of fan blade 21 on the side of positive pressure surface 24, and a straight line 107 contacting blade surface 23 of fan blade 21 on the side of negative pressure surface 25, and extending in parallel with straight line 106, a straight line 109 contacting outer peripheral portion 27 of fan blade 21 and perpendicular to straight line 106 and straight line 107, and a straight line 108 contacting inner peripheral portion 26 of fan blade 21 and perpendicular to straight line 106 and straight line 107. In cross-flow fan 10 according to the present embodiment, a chord length of fan blade 21 is represented by a length L of straight line 106 between straight line 109 and straight line 108.

Cross-flow fan 10 according to the present embodiment is configured to meet the relationships expressed by the following Formulas 1 to 3 in relation to inner diameter d and outer diameter D of fan blade 21, N representing the number of fan blades 21, M representing the number of blade wheels 12, and chord length L of fan blade 21.

1) Cross-flow fan 10 according to the present embodiment meets the following relationship.

$$0.55 \leq d/D \leq 0.95 \quad \text{(Formula 1)}$$

in cross-flow fan 10 provided with fan blades 21 having D=113.2 mm and d=89.2 mm, for example, d/D has a value approximately 0.79.

In the case where the value of d/D is smaller than 0.55, inner diameter d is too small for the dimension of outer diameter D of fan blade 21, failing to constantly generate forced vortex which is the source of an airflow crossing through the fan (airflow traversing center axis 101) which is a particularly unique feature of any cross-flow fans. This undermines the air-blow performance of fan blades 21, thereby failing to accomplish an adequate air-blow performance expected in any cross-flow fans. In the case where the value of d/D is larger than 0.95, although there is constantly forced vortex, inner diameter d is too large for the dimension of outer diameter D of fan blade 21, and it is no longer possible to have an enough chord length of fan blade 21. This undermines the dynamic lift of fan blades 21 necessary for blast, thereby failing to accomplish an adequate air-blow performance expected in any cross-flow fans.

To avoid these problems, cross-flow fan 10 according to the present embodiment, in which the ratio d/D between inner diameter d and outer diameter D of fan blade 21 stays within the range $0.55 \leq d/D \leq 0.95$, can accomplish an adequate air-blow performance as the cross-flow fans.

When the ratio d/D between inner diameter d and outer diameter D of fan blade 21 stays within the range $0.68 \leq d/D \leq 0.86$, cross-flow fan 10 can accomplish even a better air-blow performance.

Hereinafter, an example 1 carried out to confirm the operational effect exerted by Formula 1 is described.

This example prepared a plurality of cross-flow fans respectively having different d/D values. The cross-flow fans were each mounted in an air blower equipped in the indoor unit of a room air conditioner to measure air flow rates at the number of rotations 1,200 rpm based on JISB8615-1.

Figure 6:
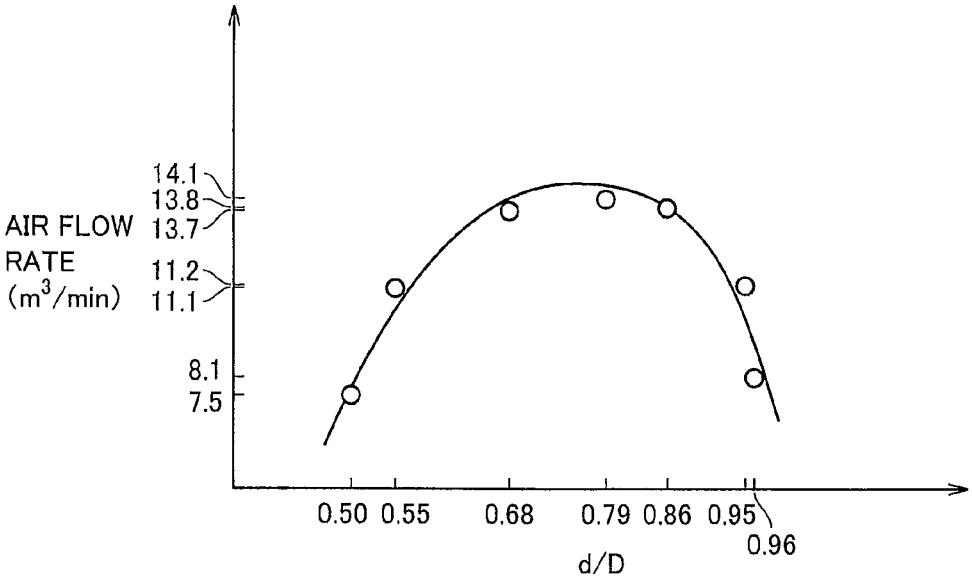
FIG. 6 is a graph illustrating a relationship between d/D and air flow rates according to an example 1.

FIG. 6 is a graph illustrating a relationship between d/D and air flow rates according to the example 1. Referring to FIG. 6, when cross-flow fan 10 meeting the relationship of Formula 1 was used, a measurement result thereby obtained showed the air flow rates of 13.7 $m^3$/min (d/D=0.68), 14.1 $m^3$/min (d/D=0.79), and 13.8 $m^3$/min (d/D=0.86). When the cross-flow fans beyond the range of Formula 1 were used as comparative examples, measurement results thereby obtained were the air flow rates of 7.5 $m^3$/min (d/D=0.50), 11.1 $m^3$/min (d/D=0.55), 11.2 $m^3$/min (d/D=0.95), and 8.1 $m^3$/min (d/D=0.96). Thus, compared with the case of using cross-flow fan 10 meeting Formula 1, the air flow rates are reduced.

It was confirmed by the example 1 that cross-flow fan 10 according to the present embodiment can reliably accomplish an adequate air-blow performance expected as the cross-flow fans.

2) Cross-flow fan 10 according to the present embodiment meets the following relationship.

$$0.6 \leq L/(\pi D/N) \leq 2.8 \quad \text{(Formula 2)}$$

For example, in cross-flow fan 10 having fan blades 21 having D=113.2 mm, N=41, and L=13.8 mm, L/(πD/N) is approximately 1.6.

The value of (πD/N) defined by outer diameter D of fan blades 21 and N representing the number of fan blades 21 in the circumferential direction is a circular arc length between adjacent fan blades 21 if fan blades 21 are spaced at equal intervals, and the value serves as a reference value of a real interval between adjacent fan blades 21. The ratio between chord length L and the arc length indicating the real interval, L/(πD/N), is equivalent to an aspect ratio of flow paths between fan blades 21 when viewed from a rotational axis direction of the fan (axial direction of center axis 101), and the ratio serves as a reference value of the impact magnitude of flow resistances received from blade surfaces 23 when the airflow passes through the flow paths between fan blades 21.

In the case where L/(πD/N) has a value smaller than 0.6, the intervals between adjacent fan blades 21 are too large for the chord length. Such too large intervals lead to the failure to adequately confer the energy from fan blades 21 to the airflow passing through the flow paths between fan blades 21, making large-scale separation more likely to happen. This undermines the air-blow performance of blades 21, thereby failing to accomplish an adequate air-blow performance expected in any cross-flow fans.

In the case where L/(πD/N) has a value larger than 2.8, the intervals between adjacent fan blades 21 are too small for the chord length. Such too small intervals overly increase the impact magnitude of the flow resistances generated on blade surfaces 23 when the airflow passes through the flow paths between fan blades 21. This lessens the air flow rate that can be delivered, considerably undermining the air-blow performance of blades 21. As a result, such a cross-flow fan fails to accomplish an expected air-blow performance.

Because the value of outer diameter D is generally not too small, N representing the number of fan blades 21 has large values when the value of L/(πD/N) is larger than 2.8. As N representing the number of fan blades 21 is larger, the arrangement of fan blades 21 in the circumferential direction is less random. As a result, narrow-band noises resulting from blade passing sounds (nZ sounds) are much louder.

To avoid such a problem, cross-flow fan 10 according to the present embodiment is configured to meet the relationship expressed by $0.6 \leq L/(\pi D/N) \leq 2.8$. The cross-flow fan thus configured can accomplish an expected air-blow performance and also effectively reduce narrow-band noises resulting from the blade passing sounds.

Meeting the relationship expressed by $1.4 \leq L/(\pi D/N) \leq 2.1$, cross-flow fan 10 can more effectively accomplish the above effects.

Hereinafter, an example 2 carried out to confirm the operational effect exerted by Formula 2 is described.

This example prepared cross-flow fans having a structural shape where D=113.2 mm, d=89.2 mm, L=13.8 mm, and M=10, and changed N representing the number of fan blades 21 to obtain different values of L/(πD/N). The cross-flow fans thus prepared were each mounted in an air blower equipped in the indoor unit of a room air conditioner to measure air flow rates and noises. The air flow rates were measured based on JISB8615-1, and the noises were measured based on JISC9612.

Figure 7:
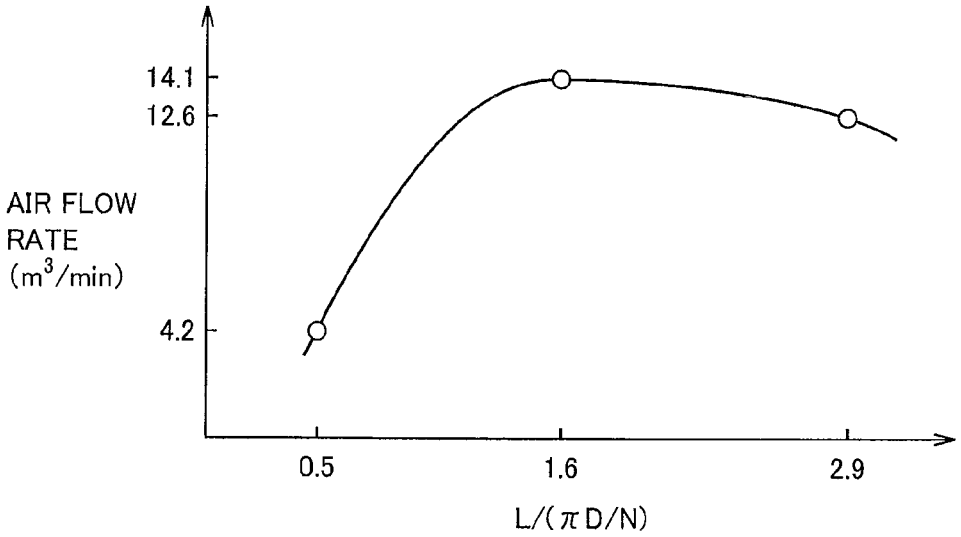
FIG. 7 is a graph illustrating a relationship between $L/(\pi D/N)$ and air flow rates according to an example 2.

FIG. 7 is a graph illustrating a relationship between L/(πD/N) and air flow rates according to the example 2. Referring to FIG. 7, it was confirmed that when cross-flow fan 10 where L/(πD/N)=1.6 meeting the relationship of Formula 2 was used, the air flow rate measured at the number of rotations of 1,200 rpm was approximately 14.1 $m^3$/min.

When the cross-flow fan where L/(πD/N)=0.5 was used as a comparative example, the air flow rate measured at the same number of rotations, 1,200 rpm, was approximately 4.2 $m^3$/min. Thus, the air flow rate considerably decreased. In the given comparative example, the air flow rate measured at the number of rotations of 2,000 rpm was approximately 7.0 $m^3$/min. Thus, it was confirmed that the comparative example fails to accomplish an expected air-blow performance. Note that in order to more increase the number of rotations, it is necessary to take additional measures for strength enhancement such as using metals as the material of fan blades 21 to be strong enough against a centrifugal force, so that the comparative example is not preferable.

The cross-flow fan where L(πD/N)=2.9 used as a comparative example resulted in the air flow rate of 12.6 $m^3$/min at the number of rotations 1,200 rpm. Thus, the air flow rate decreased although the number of fan blades was increased.

Figure 8:
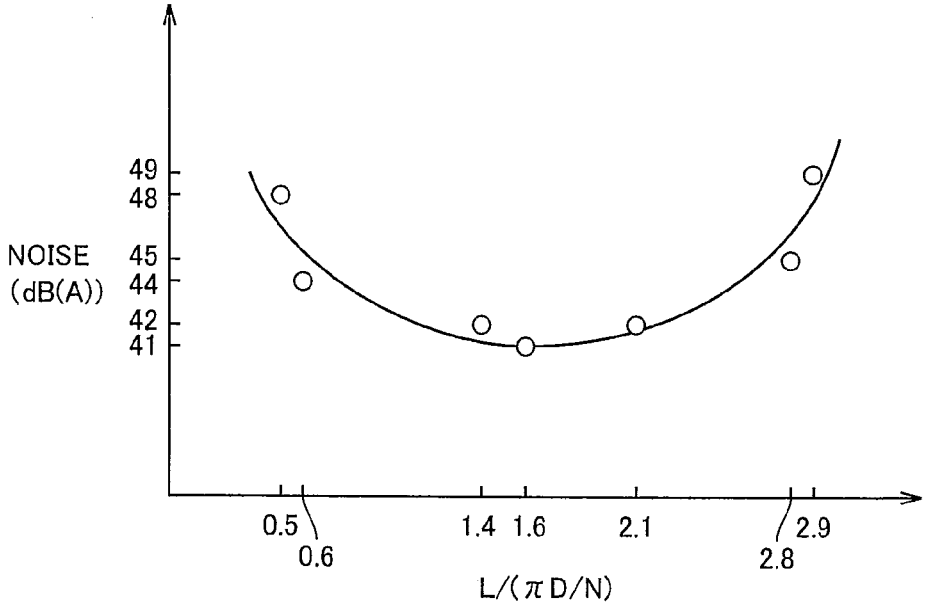
FIG. 8 is a graph illustrating a relationship between $L/(\pi D/N)$ and noise values according to the example 2.

FIG. 8 is a graph illustrating a relationship between L/(πD/N) and noise values according to the example 2. Referring to FIG. 8, the noise values of cross-flow fans 10 meeting the relationship expressed by Formula 2 when the air flow rate of 10 $m^3$/min was obtained were; approximately 44 dB (A) (L(πD/N)=0.6), approximately 42 dB (A) (L(πD/N)=1.4), approximately 41 dB (A) (L(πD/N)=1.6), approximately 42 dB (A) (L(πD/N)=2.1), and approximately 45 dB (A) (L(πD/N)=2.8).

When the cross-flow fan where L/(πD/N)=0.5 was as used as a comparative example, the noise value when the same air flow rate of 10 $m^3$/min was obtained was approximately 48 dB (A). Particularly, broad-band noises significantly increased, thus exhibiting adverse impacts resulting from large-scale separation between adjacent fan blades 21. When the cross-flow fan where L/(πD/N)=2.9 was as used as a comparative example, the noise value when the same air flow rate of 10 $m^3$/min was obtained was approximately 49 dB (A), thus exhibiting adverse impacts resulting from the significantly increased narrow-band noises.

It was confirmed from the example 2 described so far that cross-flow fan 10 according to the present embodiment meeting the relationship of Formula 2 succeeds in improving the air-blow performance and reducing the narrow-band noises caused by the blade passing sounds.

3) Cross-flow fan 10 according to the present embodiment meets the following relationship.

$$0.15 \leq \pi D/(N \times M) \leq 3.77 \quad \text{(Formula 3)}$$

In cross-flow fan 10 provided with fan blades 21 and blade wheels 12, formed such that D=113.2 mm, N=41, and M=10, for example, πD/(N×M) has a value approximately 0.87.

The value of πD/(N×M) defined by outer diameter D of fan blades 21, N representing the number of fan blades 21, and M representing the number of blade wheels 12 is a value used as a reference value for estimating the likelihood of overlap between fan blades 21 at circumferential positions on the outer diameter in different blade wheels 12 when cross sectional surfaces of all of fan blades 21 provided in the fan are projected on a plane orthogonal to center axis 101.

In the case where the value of πD(N×M) is smaller than 0.15, there are too many fan blades 21 in total for the circumferential length of fan blades 21, resulting in more fan blades 21 in different blade wheels 12 overlapping at circumferential positions on the outer diameter. This involves the risk of increasing adverse impacts caused by narrow-band noises resulting from too many overlapping blades. In the case where the value of πD/(N×M) is larger than 3.77, N representing the number of fan blades 21 is too small, possibly overly widening the intervals between adjacent fan blades 21 as described earlier, or failing to ensure a fan length in the axial direction of center axis 101 long enough to constantly generate forced vortex which is the source of the airflow crossing through the fan because of M representing the number of blade wheels 12 is too small. The occurrence of these unfavorable events undermines the air-blow performance of fan blades 21. As a result, an adequate air-blow performance expected in any cross-flow fans cannot be accomplished.

In contrast to these examples, cross-flow fan 10 according to the present embodiment meeting the relationship expressed by 0.15≤πD(N×M)≤3.77 can ensure an adequate air-blow performance expected in any cross-flow fans. More particularly, cross-flow fan 10 can avoid any greatly adverse impacts caused by narrow-band noises resulting from too many fan blades 21 or too many overlapping fan blades 21 at circumferential positions on the outer diameter in the different blade wheels.

More preferably, cross-flow fan 10 meets the relationship expressed by 0.43≤πD(N×M)≤2.83. In this case, not too many fan blades 21 overlap at circumferential positions on the outer diameter in different blade wheels 12, so that it is possible to more effectively control any adverse impacts resulting from narrow-band noises. Further, significant deterioration of the air-blow performance caused by too small N representing the number of fan blades 21 and too small M representing the number of blade wheels 12 can be prevented. As a result, an adequate air-blow performance expected as the cross-flow fans can be adequately accomplished.

Depending on a use of cross-flow fan 10, M representing the number of blade wheels 12 changes, and a suitable numeral range of πD/(N×M) accordingly changes. The value of πD(N×M) preferably stays within the numeral range of 0.43≤πD(N×M)≤1.68 when cross-flow fan 10 is used in electric devices where M representing the number of blade wheels 12 is relatively large (M≥5) such as air conditioner, electric fan, and ventilating device. However, the value of πD(N×M) more suitably stays within the numeral range of 1.34≤πD(N×M)≤2.83 when cross-flow fan 10 is used in electric devices where M representing the number of blade wheels 12 is relatively small (M≤6) such as air purifier, humidifier, and dehumidifier.

Next, an example 3 carried out to confirm the operational effect exerted by Formula 3 is described.

The example prepared cross-flow fans having a structural shape where D=113.2 mm, d=89.2 mm, and L=13.8 mm, and changed N representing the number of fan blades 21 and M representing the number of blade wheels 12 to obtain different values of πD(N×M). The cross-flow fans thus prepared were each mounted in an air blower equipped in the indoor unit of a room air conditioner to measure air flow rates and noises. The air flow rates were measured based on JISB8615-1, and the noises were measured based on JISC9612.

Figure 9:
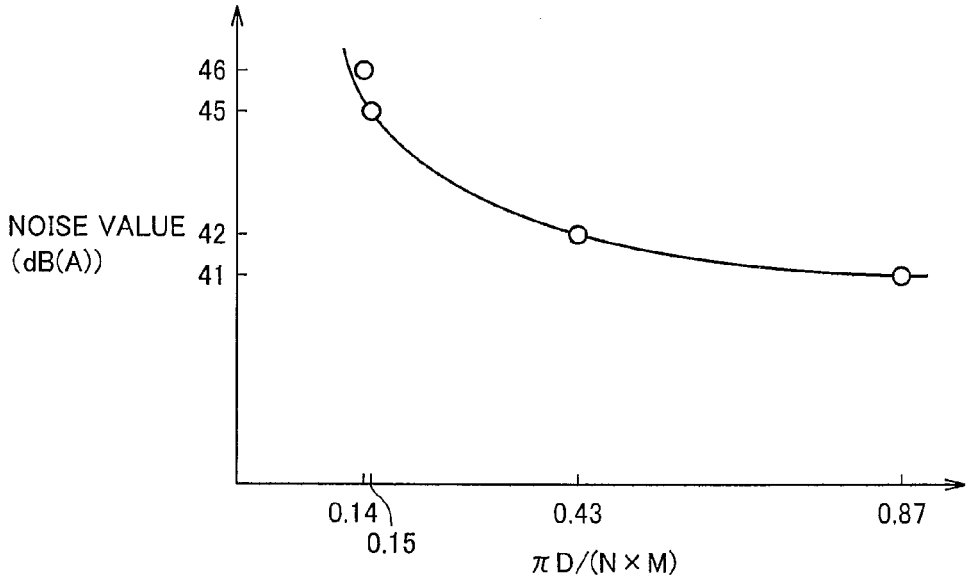
FIG. 9 is a graph illustrating a relationship between $\pi D/(N \times M)$ and noise values according to an example 3.

FIG. 9 is a graph illustrating a relationship between πD(N×M) and noise values according to the example 3. Referring to FIG. 9, cross-flow fans 10 meeting the relationship of Formula 3 resulted in the noise values when the same air flow rate (10 $m^3$/min) was obtained were; approximately 45B (A) ($\pi D$ ($N \times M$=0.15), approximately 42 dB (A) ($\pi D/(N \times M)$=0.43), and approximately 41 dB (A) ($\pi D(N \times M)$=0.87). When the cross-flow fan beyond the range of Formula 3 was used for comparison, the noise values to obtain the same air flow rate (10 $m^3$/min) was approximately 46 dB (A) ($\pi D(N \times M)$=0.14). As compared to cross-flow rate 10 where $\pi D/(N \times M)$=0.87 meeting the relationship of Formula 3, the cross-flow fan for comparison showed increases of not more than approximately 9 dB (A) in a noise level at blade passing frequencies, and not more than approximately 5 dB (A) in an overall noise value.

Figure 10:
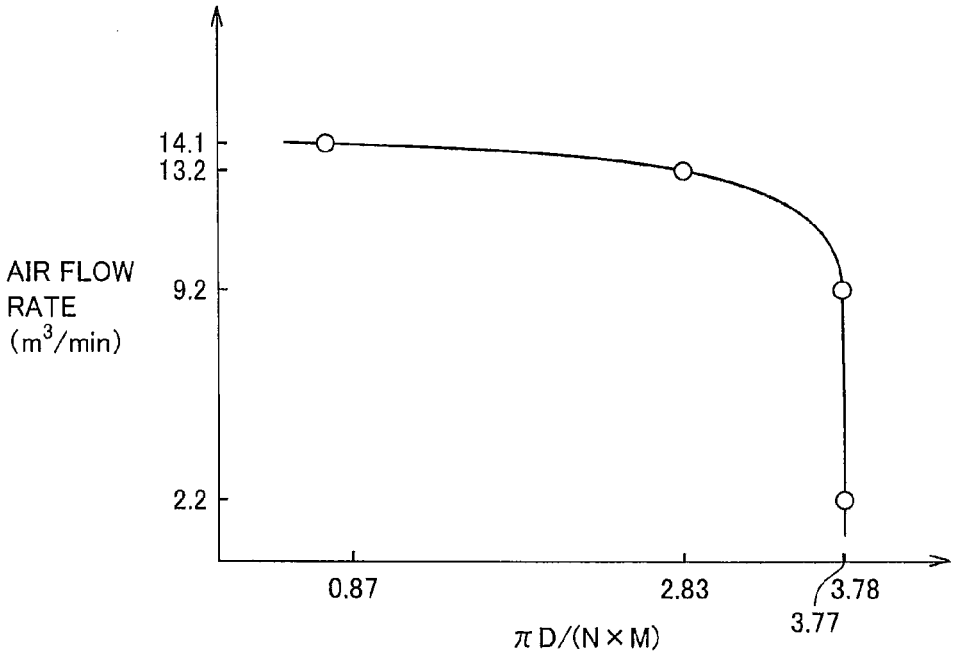
FIG. 10 is a graph illustrating a relationship between $\pi D/(N \times M)$ and air flow rates according to the example 3.

FIG. 10 is a graph illustrating a relationship between $\pi D(N \times M)$ and air flow rates according to the example 3. Referring to FIG. 10, cross-flow fans 10 meeting the relationship expressed by Formula 3 resulted in the air flow rates at the number of rotations 1,200 rpm, respectively; approximately 14.1 $m^3$/min ($\pi D/(N \times M$=0.87), approximately 13.2 $m^3$/min ($\pi D(N \times M$=2.83), and approximately 9.2 $m^3$/min ($\pi D$ ($N \times M$=3.77). When the cross-flow fan beyond the range of Formula 3 was used for comparison, the air flow rate at the same number of rotations, 1,200 rpm, was approximately 2.2 $m^3$/min ($\pi D(N \times M$=3.78). It was confirmed from these results that there were more reductions in the measured air flow rates than estimated from the reductions in N representing the number of fan blades 21 and M representing the number of blade wheels 12.

It was confirmed from the example described so far that cross-flow fan 10 according to the present embodiment meeting the relationship expressed by Formula 3 can ensure an adequate air-blow performance of the cross-flow fans and avoid any greatly adverse impacts caused by narrow-band noises.

4) Cross-flow fan 10 according to the present embodiment preferably meets the following relationship.

$$0.05(\pi D/N) \leq |Cn-(\pi D/N)| \leq 0.24(\pi D/N) \quad \text{(Formula 4)}$$

Cross-flow fan 10 meets Formula 4 described above in respective values of Cn (n=1, 2, . . . , N−1, N), meaning that Formula 4 may be rewritten into $0.05(\pi D/N) \leq \text{Min}|Cn-(\pi D/N)|$, and $\text{Max}|Cn-(\pi D/N)| \leq 0.24(\pi D/N)$.

($\pi D/N$) represents intervals between fan blades 21 when fan blades 21 are equally spaced around center axis 101. $|Cn-(\pi D/N)|$ represents a degree of variability of intervals between fan blades 21 as compared to the arrangement of fan blades 21 equally spaced around center axis 101.

In the case where $\text{Min}|Cn-(\pi D/N)|$ is smaller than 5% of ($\pi D/N$), fan blades 21 are almost equally spaced, involving the risk of considerably increasing the blade passing sounds. In the case where $\text{Max}|Cn-(\pi D/N)|$ is larger than 24% of ($\pi D/N$), some of fan blades 21 are too distantly spaced from each other around center axis 101, involving the risk of large separation sounds at the overly large intervals.

In contrast, cross-flow fan 10 according to the present embodiment meeting the relationship expressed by $0.05(\pi D/N) \leq |Cn-(\pi D/N)| \leq 0.24(\pi D/N)$ can effectively control the occurrence of the passing sounds and separation sounds of fan blades 21.

Next, an example 4 carried out to confirm the function and effect exerted by Formula 4 is described.

This example prepared a plurality of cross-flow fans having different ratios between $|Cn-(\pi D/N)|$ and ($\pi D/N$). The cross-flow fans were each mounted in an air blower equipped in the indoor unit of a room air conditioner to measure noise values when the air flow rate of 10 $m^3$/min is obtained. The noise values were measured based on JISC9612.

According to a measurement result thereby obtained, the noise values obtained in the cross-flow fans meeting the relationship of Formula 4 were, respectively; approximately 43 dB (A) ($\text{Min}|Cn-(\pi D/N)|$ being 5% of ($\pi D/N$) and $\text{Max}|Cn-(\pi D/N)|$ being 12% of ($\pi D/N$)), approximately 41 dB (A) ($\text{Min}|Cn-(\pi D/N)|$ being 8% of ($\pi D/N$) and $\text{Max}|Cn-(\pi D/N)|$ being 12% of ($\pi D/N$)), and approximately 44 dB (A) ($\text{Min}|Cn-(\pi D/N)|$ being 8% of ($\pi D/N$) and $\text{Max}|Cn-(\pi D/N)|$ being 24% of ($\pi D/N$)). On the other hand, cross-flow fans beyond the range of Formula 4 used for comparison resulted in the noise values, respectively; approximately 51 dB (A) ($\text{Min}|Cn-(\pi D/N)|$ being 3% of ($\pi D/N$) and $\text{Max}|Cn-(\pi D/N)|$ being 12% of ($\pi D/N$)), and approximately 50 dB (A) ($\text{Min}|Cn-(\pi D/N)|$ being 8% of ($\pi D/N$) and $\text{Max}|Cn-(\pi D/N)|$ being 30% of ($\pi D/N$)).

It was confirmed by the example 4 that cross-flow fan 10 according to the present embodiment meeting the relationship of Formula 4 can effectively control the occurrence of the passing sounds and/or separation sounds of fan blades 21.

[Description of Displacement Angle between Blade Wheels]

Cross-flow fan 10 according to the present embodiment is formed such that plural blade wheels 12 are stacked on one another in a manner that a displacement angle θ is generated between adjacent blade wheels 12 when viewed from the axial direction of center axis 101.

A more detailed description is given focusing on blade wheel 12A, blade wheel 12B, and blade wheel 12C illustrated n FIG. 1 arranged in the mentioned order adjacent to one another. Blade wheel 12B is stacked on blade wheel 12A in a manner that all of fan blades 21 in blade wheels 12A and 12B both are displaced in the circumferential direction of center axis 101 by displacement angle θ from positions where these fan blades 21 overlap in the axial direction of center axis 101. Blade wheel 12C is stacked on blade wheel 12B in a manner that all of fan blades 21 in blade wheels 12C and 12B both are displaced in the circumferential direction of center axis 101 by displacement angle θ (2θ when viewed from the side of blade wheel 12A) from positions where these fan blades 21 overlap in the axial direction of center axis 101.

Describing the reason for providing displacement angle θ, the positions of fan blades 21 in different wheel blades 12 are intentionally displaced in the axial direction of center axis 101, so that the blade passing sounds (nZ sounds) generated in the respective blade wheels 12 can counteract each other to be weakened.

In cross-flow 10 fan according to the present embodiment, displacement angle is set to stay within the range of $(1.2 \times 360°/(N \times M)) \leq \theta \leq (360°/N)$, and the overlapping number of fan blades 21 having an equal installation angle is at most 5% of the N×M blades 21 in total. This structural feature can control the occurrence of narrow-band noises resulting from the blade passing sounds (nZ sounds) to such an extent that they are no longer auditorily disturbing noises in a structure where N representing the number of fan blades 21 is particularly large.

Next, a method of calculating "overlapping number" required to deciding the displacement angle is described.

According to the present embodiment, the displacement angle is set to 0.1° based on a dimensional accuracy when a molding die for cross-flow fan 10 is produced.

(1) A plane orthogonal to center axis 101 is hypothetically set, and outer diameter D of fan blade 21 and a circle having a diameter equal thereto (hereinafter, called circumscribed circle, which is equivalent to circumscribed circle 315 illustrated in FIG. 4) are drawn on the plane.

(2) A point is set at any position on the circumscribed circle, and the point is defined as a reference point of the displacement angle.

(3) A point of contact of a circumscribed circle relating to fan blade 21 with fan blade 21 is obtained, and an angle made by the point of contact and the reference point (angle of an arc connecting the point of contact to the reference point on the circumscribed circle) based on a center point of the circumscribed circle (center axis 101) is defined as the installation angle of fan blade 21.

The value of the installation angle has digits that depend on a dimensional accuracy in molding cross-flow fan 10. The present embodiment sets the digits depending on the dimensional accuracy when the molding die for blade wheel 12 is produced, employing a numeral range to one place of decimals.

(4) The installation angles of all of fan blades 21 in cross-flow fan 10 other than that of fan blade 21 recited in (3) are similarly obtained.

(5) It is calculated how many of fan blades 21 have an equal installation angle.

(6) The values calculated in (5) are summed and used as the "overlapping number".

In an assumed cross-flow fan where N=40 fan blades 21 are equally spaced, "M representing the number of blade wheels 12"=10, and "displacement angle θ"=0° (a largest number of fan blades 21 are overlapping), for example, according to the described calculation steps, the overlapping number of fan blades 21 in the cross-flow fan is calculated.

Upon setting the installation angles of fan blade 21 on one blade wheel 12 so that the reference point corresponds to the installation position of one fan blade 21, the installation angles are respectively 0°, 9°, 18°, 27°, . . . , 342°, and 351°. Because of the displacement angle being set to 0°, the installation angles of 40 fan blades 21 in any other blade wheels 12 are similarly set.

Counting the blades having the same installation angle as fan blades 21 having the installation angle of 0° in blade wheel 12 according to the step recited in (5), the counted blades are all of fan blades 21 in other nine blade wheels 12 having the installation angle of 0°. The overlapping number of fan blades 21 at the installation angle 0° based on blade wheel 12 is nine. A counting result of the overlapping number for the other installation angles of blades 21 (9°, 18°, . . . ) is also nine. The overlapping number is similarly calculated in any other blade wheels 21. Therefore, the "overlapping number" calculated according to the step recited in (6) is 9×40 (nine of all of fan blades 21 in blade wheel 12 have the same installation angle)×10 (all of 10 blade wheels 12 similarly have the same calculation result)=3,600, which is the overlapping number of fan blades 21.

In this case, the overlapping number is way over 400 (40×10) fan blades 21 in total. Thus, it is easily understood that all of fan blades 21 numerically contribute to the occurrence of the blade passing sounds (narrow-band noises), thereby exerting a significant influence. Studying overlapping number based on the total number of fan blades 21, an extent of contribution by the "overlapping number" to the blade passing sounds (narrow-band noises) can be easily estimated.

In an exemplified cross-flow fan where N representing the number of fan blades 21 and M representing the number of blade wheels 12 are both relatively small used as a reference example, it was studied how the overlapping number changes when the displacement angle is arbitrarily changed.

Figure 11:
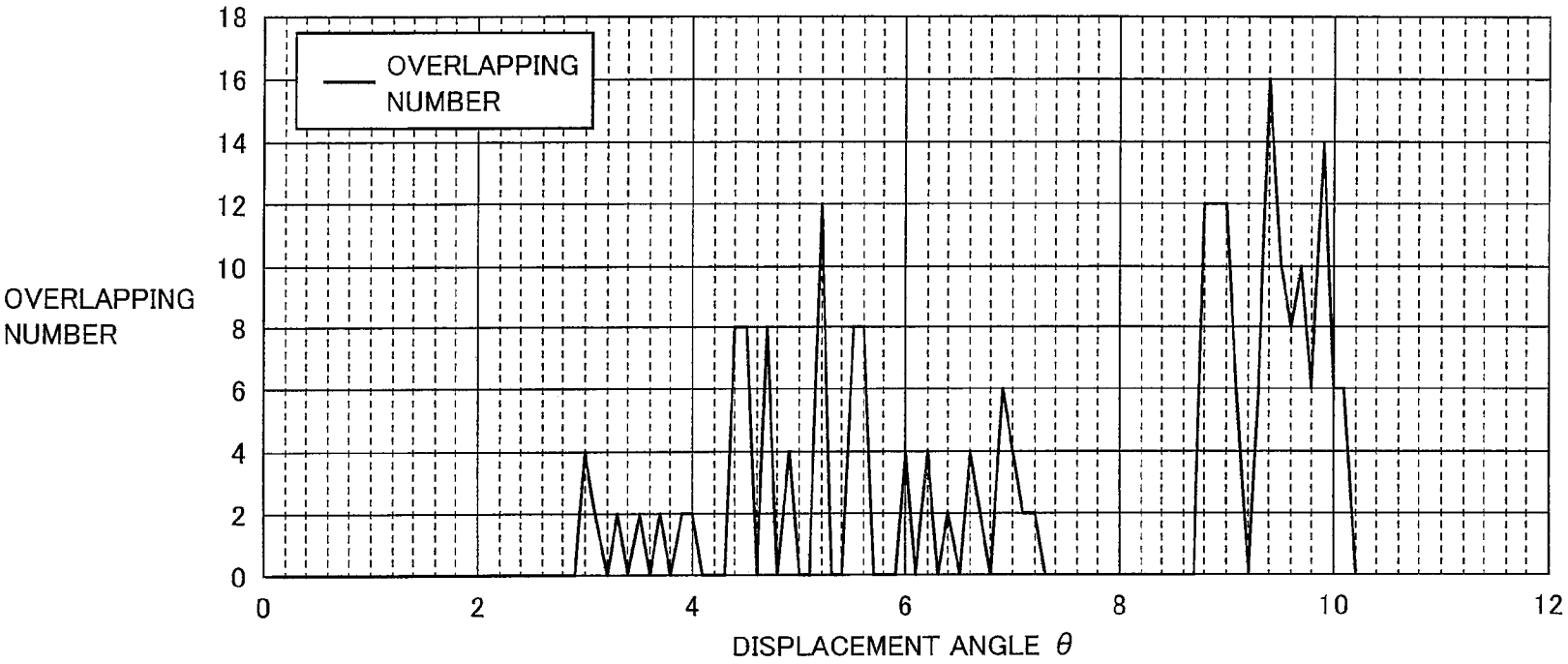
FIG. 11 is a graph illustrating a relationship between displacement angles between adjacent blade wheels and respective overlapping numbers of fan blades in a cross-flow fan according to a reference example.

FIG. 11 is a graph illustrating a relationship between displacement angles between adjacent blades and respective overlapping numbers of fan blades in the cross-flow fan according to the reference example.

Referring to FIG. 11, a cross-flow fan having a structural shape where D=98.2 mm, d=74.1 mm, L=13.8 mm, N=35, and M=4 was assumed as the cross-flow fan where N representing the number of fan blades 21 and M representing the number of blade wheels 12 are both relatively small. The installation angles of fan blades 21 in one blade wheel 12 were calculated according to the overlapping number calculation step recited in (4), and the installation angles of fan blades 21 in any other blade wheels 12 were calculated with the displacement angle taken into account, so that the installation angles of all of the fan blades 21 were obtained.

Referring to the graph illustrated in FIG. 11, a result thereby obtained indicated that the overlapping number is 0 at many displacement angles, and there is a region where the overlapping is continuously 0. The selection of the displacement angle is relatively easy as far as N representing the number of fan blades 21 and M representing the number of blade wheels 12 are both relatively small.

Then, it was studied how the overlapping number changes when the displacement angle is arbitrarily changed in cross-flow fan 10 having a shape where D =113.2 mm, d=89.2 mm, L=13.8 mm, N=41, and M=10.

In cross-flow fan 10 according to the example, displacement angle θ is set to stay within the range of 1.05°≤θ≤8.78°, and the overlapping number of fan blades 21 having the same installation angles is at most 5% of 410 fan blades 21 in total, that is at most 20 fan blades 21.

Figure 12:
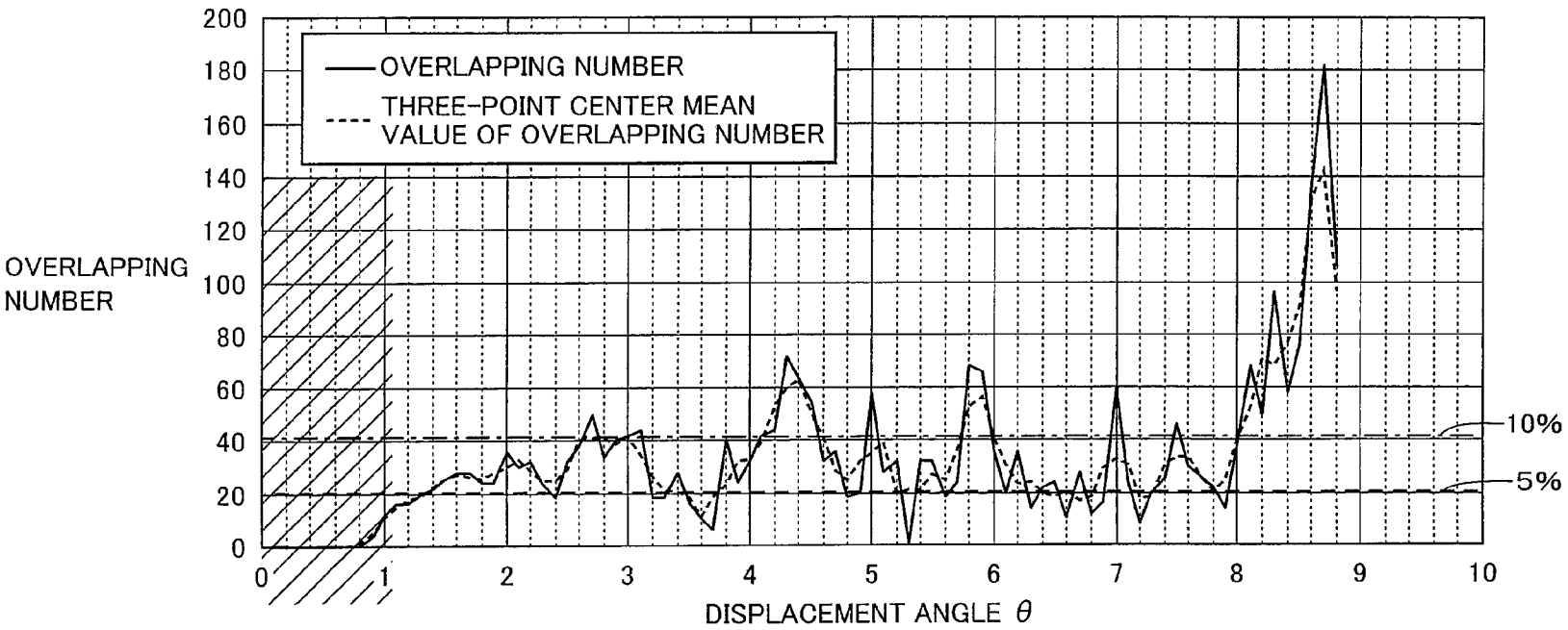
FIG. 12 is a graph illustrating a relationship between displacement angles between adjacent blade wheels and respective overlapping numbers of fan blades.

FIG. 12 is a graph illustrating a relationship between the displacement angles between adjacent blade wheels and the respective overlapping numbers of fan blades. Referring to the graph illustrated in FIG. 12, the overlapping number is likely to increase in a structure where N representing the number of fan blades 21 and M representing the number of blade wheels 12 are both large. This means that the present invention is more effectively applicable to any cross-flow fans having a structural shape where N>35 and M>4. Particularly, the present invention is more suitably applicable to any cross-flow fans having a shape where N>40 and M>6 because the structural shape can significantly narrow a region where the overlapping number is small, thereby easily increasing the overlapping number of blades.

The cross-flow fans respectively having different displacement angles were each mounted in an air blower equipped in the indoor unit of a room air conditioner to measure noise values, In this case, the measurement was performed based on JISC9612.

FIG. 13 is a table reciting respective overlapping numbers of fan blades at different displacement angles, ratios of the overlapping numbers, and noise values. Referring to FIG. 13, cross-flow fans where displacement angle θ is 2.4°, 3.6°, 5.3°, 6.1°, and 7.2° represent the examples, while cross-flow fans where displacement angle θ is 0.4°, 1.0°, 1.9°, 2.8°, and 5.9° represent the examples.

The cross-flow fans where displacement angle θ=0.4° and 1.0° resulted in large noise values irrespective of relatively small overlapping numbers of fan blades 21 possibly because of not enough magnitude of difference between the installation angles of respective blade wheels 12 although there are not many overlaps between the installation angle of fan blades 21 per se. This lessens the effect of displacing fan blades 21 between different blade wheels 12, practically making the displacement angle to almost 0°.

Figure 14:
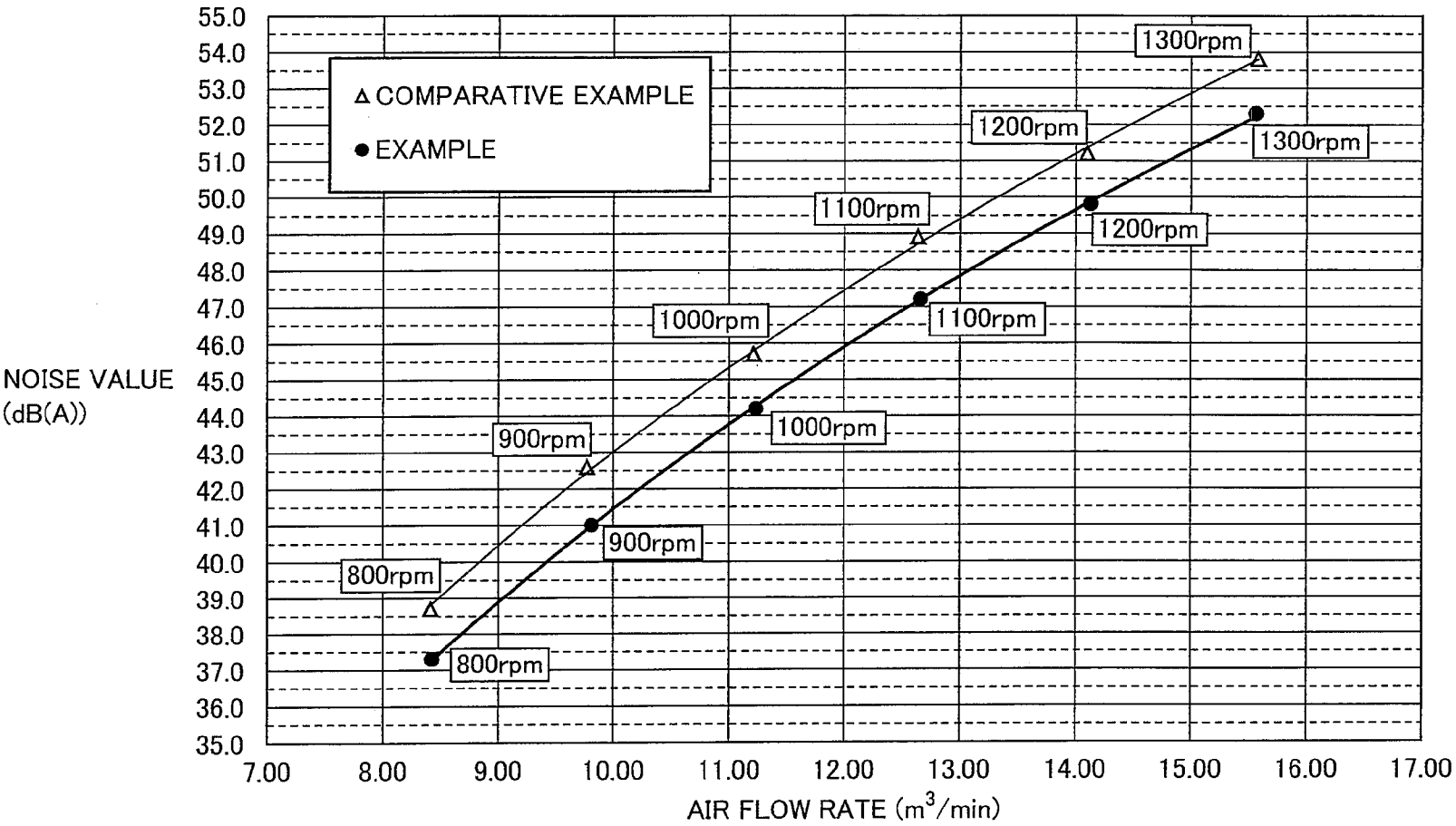
FIG. 14 is a graph illustrating a relationship between air flow rates and noise values in cross-flow fans according to comparative and examples.
Figure 15:
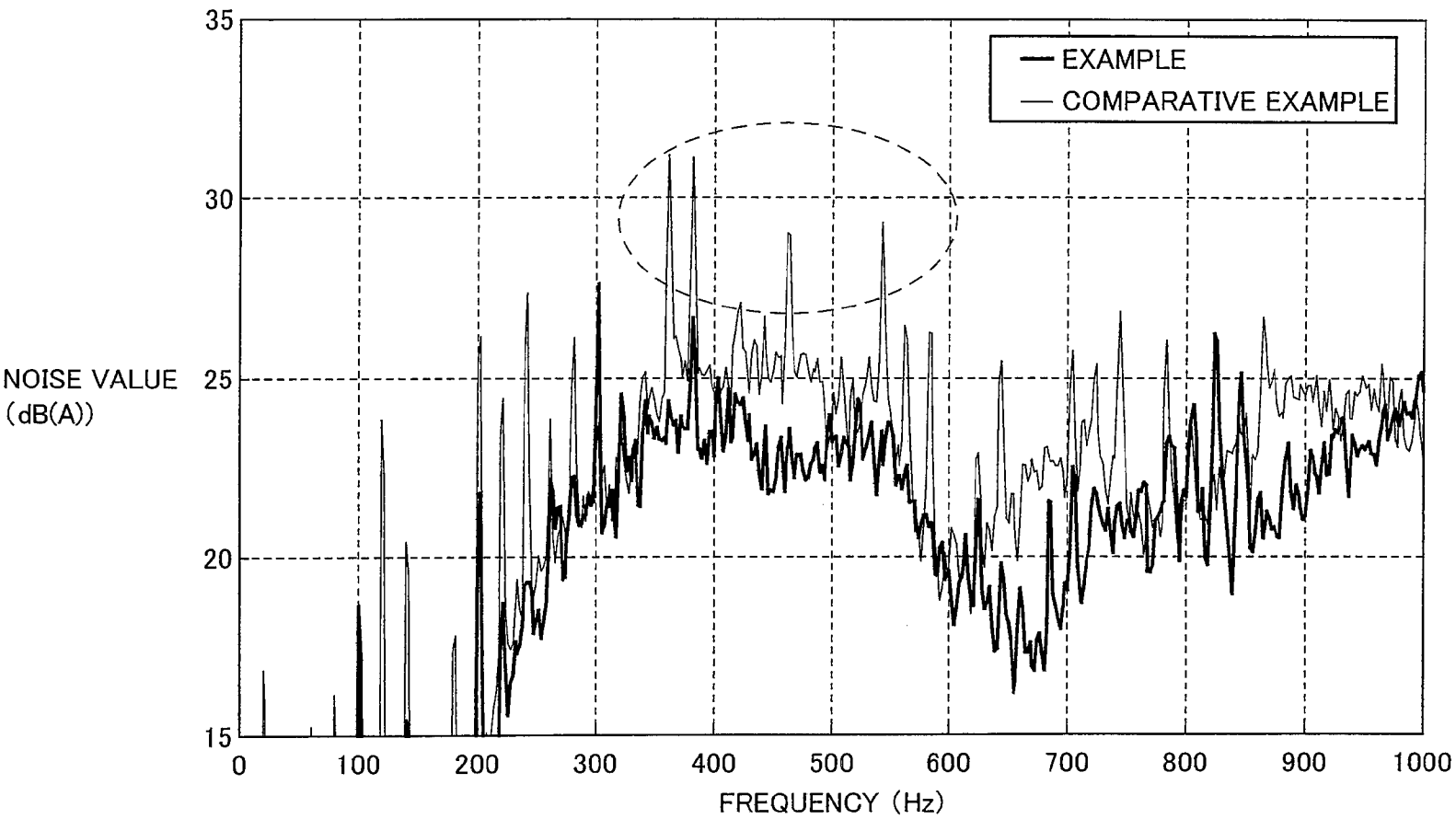
FIG. 15 is a graph illustrating a relationship between air flow rates and frequencies in the cross-flow fans according to the examples and comparative examples.

FIG. 14 is a graph illustrating a relationship between the air flow rates and the noise values in the cross-flow fans according to the comparative and examples. FIG. 15 is a graph illustrating a relationship between the air flow rates and frequencies in the cross-flow fans according to the comparative and examples. These drawings illustrate data of the cross-flow fan according to the comparative example having displacement angle θ=1.0° and the cross-flow fan according to the example having displacement angle θ=3.6°, in which of both the overlapping number is equally set to 10.

As is understood from the graph illustrated in FIG. 14, the cross-flow fan according to the comparative example having displacement angle θ=1.0° resulted in a larger noise value regardless of the same air flow rate at the same number of rotations. This indicates that air-blow noises associated with the air flow rates are the same but the blade passing sounds generated are different in the respective cross-flow fans. Referring to FIG. 15, the cross-flow fan according to the comparative example having displacement angle θ=1.0° showed an increase in the narrow-band noises particularly in a region from 350 Hz to 550 Hz. On the other hand, the narrow-band noises are not very conspicuous in the cross-flow fan according to the example having displacement angle θ=3.6°. In some of the regions where the displacement angle is relatively small, the blade passing sounds are generated although the overlapping number is small. It is known from the result that displacement angle θ between adjacent blade wheels 12 is preferably equal to or larger than 1.2×360°(N×M).

In the case where displacement angle θ overly increases, the installation angles of fan blades 21 are unfavorably equal in some regions. Therefore, displacement angle θ of fan blades 21 is preferably equal to or smaller than 360°/N.

Referring to FIG. 13, the cross-flow fans where displacement angle θ=2.4°, 3.6°, 5.3°, 6.1°, and 7.2° resulted in almost the same noise values. There are the following two factors for the noise values of these cross-flow fans. In the cross-flow fans where displacement angle θ=2.4°, 3.6°, 6.1°, and 7.2°, the overlapping number is relatively small, hardly exerting a large influence. In the cross-flow fan where displacement angle θ=5.3°, the overlapping number is 0 but the overlapping number is relatively large at near displacement angles (5.2°, 5.4°), suggesting that the actual displacement angle was shifted to one of these near displacement angles under the influences of a degree of accuracy during molding. In the cross-flow fans wherein displacement angle θ=1.9°, 2.8°, and 5.9°, noises generated therein showed large values in correlation to the overlapping numbers, meaning that these cross-flow fans were subjected to large impacts from the blade passing sounds as the overlapping number increased.

Using a ratio of the overlapping number to N×M representing the total number of blades 21 in the fan to determine a suitable overlapping number, when displacement angle θ is set so that the overlapping number is at most 5% of N×M representing the total number of blades 21, the noise value can be set to a preferable noise level.

To avoid any influences from the degree of accuracy during molding, an optimal value of the displacement angle may be assessed based on a center mean value of the overlapping number. FIG. 12 illustrates a graph of three-point center mean values of the overlapping number (for example, the three-point center mean value at displacement angle θ=5.3° is a value calculated by diving the overlapping numbers at displacement angle θ=5.2°, 5.3°, and 5.4° by three). It is known from the illustrated graph that displacement angle θ=3.6° is more suitable than displacement angle θ=5.3°.

As far as such a noise increase as approximately 0.5 dB (A) is tolerable, displacement angle θ is set so that the overlapping number is at most 10% of N×M representing the total number of fan blades 21 as in the cross-flow fan wherein displacement angle θ=2.8°. In the cross-flow fan where displacement angle θ=2.8°, the total number of fan blades 21 is 410 and the overlapping number is 38. Therefore, the overlapping number is approximately 9.2% of N×M representing the total number of fan blades 21.

Embodiment 2

This embodiment describes a structure of an air conditioner in which cross-flow fan 10 illustrated in FIG. 1 is used.

Figure 16:
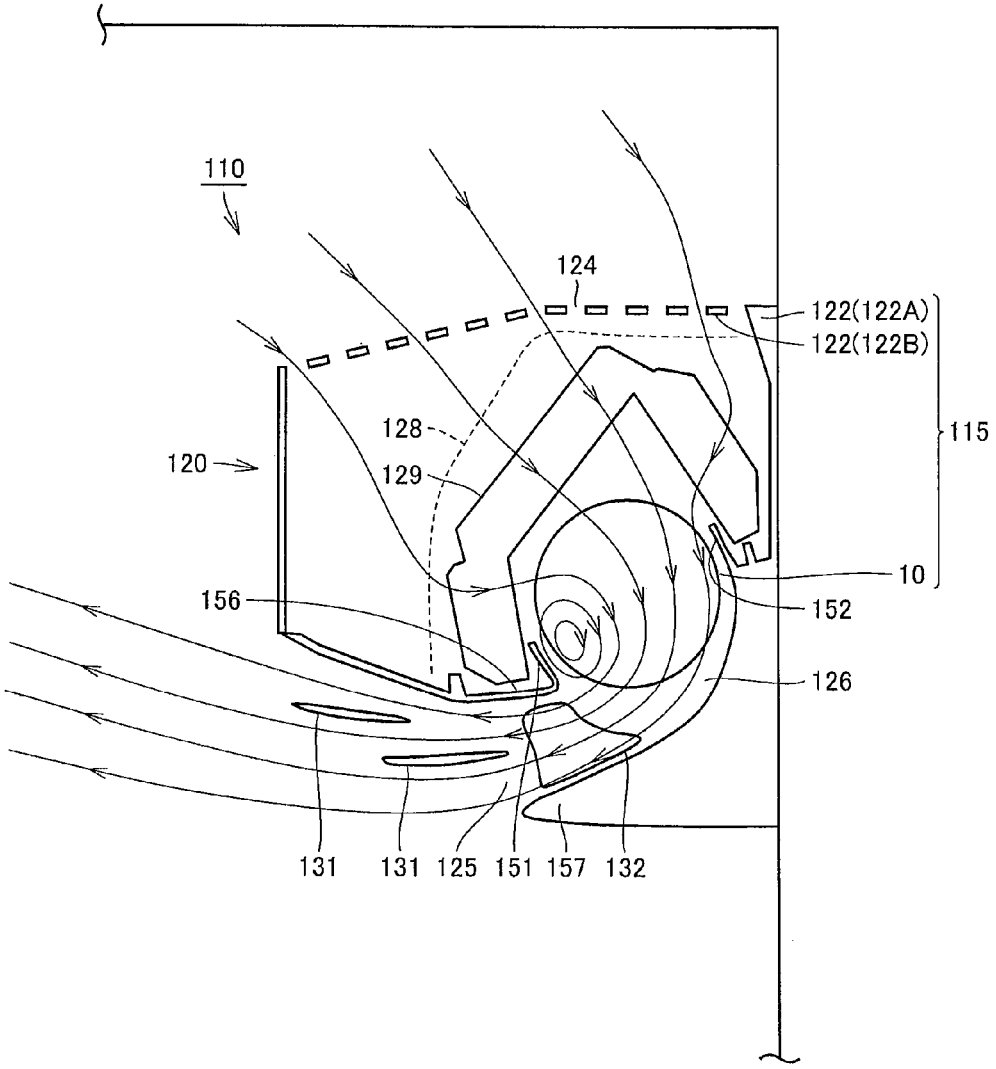
FIG. 16 is a sectional view of an air conditioner in which the cross-flow fan illustrated in FIG. 1 is used.

FIG. 16 is a sectional view of an air conditioner in which the cross-flow fan illustrated in FIG. 1 is used. Referring to FIG. 16, an air conditioner 110 includes an indoor unit 120 placed inside a room and equipped with an indoor heat exchanger 129, and an outdoor unit, not illustrated in the drawings, placed outside the room and equipped with an outdoor heat exchanger and a compressor. Indoor unit 120 and the outdoor unit are connected to each other by a pipe arrangement to circulate a refrigerant gas between indoor heat exchanger 129 and the outdoor heat exchanger.

Indoor unit 120 has an air blower 115. Air blower 115 has a cross-flow fan 10, a drive motor, not illustrated in the drawings, which rotates cross-flow fan 10, and a casing 122 for generating a required airflow along with the rotation of cross-flow fan 10.

Casing 122 has a cabinet 122A and a front panel 122B. Cabinet 122A is supported on a wall surface inside the room, and front panel 122B is detachably mounted in cabinet 122A. A blowout port 125 is formed in an interval between a lower end part of front panel 122B and a lower end part of cabinet 122A. Blowout port 125 is formed in a substantially rectangular shape extending in a width direction of indoor unit 120 and provided facing forward and downward. An upper surface of front panel 122B has an intake port 124 formed in a lattice shape.

At a position facing front panel 122B, an air filter 128 is provided to catch and remove dust included in air sucked in through intake port 124. An air filter cleaning device, not illustrated in the drawings, is provided in a space formed between front panel 122B and air filter 128. The air filter cleaning device automatically removes dust accumulated in air filter 128.

An air-blow passage 126 for the air to travel through from intake port 124 toward blowout port 125 is formed inside casing 122. Blowout port 125 is provided with a vertical louver 132 configured to direct a right-left blowout angle in right and left directions, and a plurality of lateral louvers 131 configured to direct an upper-lower blowout angle in forward and upward, horizontal, forward and downward, and downward directions.

Indoor heat exchanger 129 is provided between cross-flow fan 10 and air filter 128 on the route of air-blow passage 126. Indoor heat exchanger 129 has winding refrigerant pipes, not illustrated in the drawings, arrayed in a plurality of stages in an upper-lower direction and a plurality of rows in a front-back direction in parallel with each other. Indoor heat exchanger 129 is connected to the compressor of the outdoor unit placed outside the room, and a refrigeration cycle is operated by a drive of the compressor. When the refrigeration cycle is operated, indoor heat exchanger 129 is cooled down to lower temperatures than ambient temperature during cooling operation, and indoor heat exchanger 129 is heated to higher temperatures than ambient temperature during heating operation.

Figure 17:
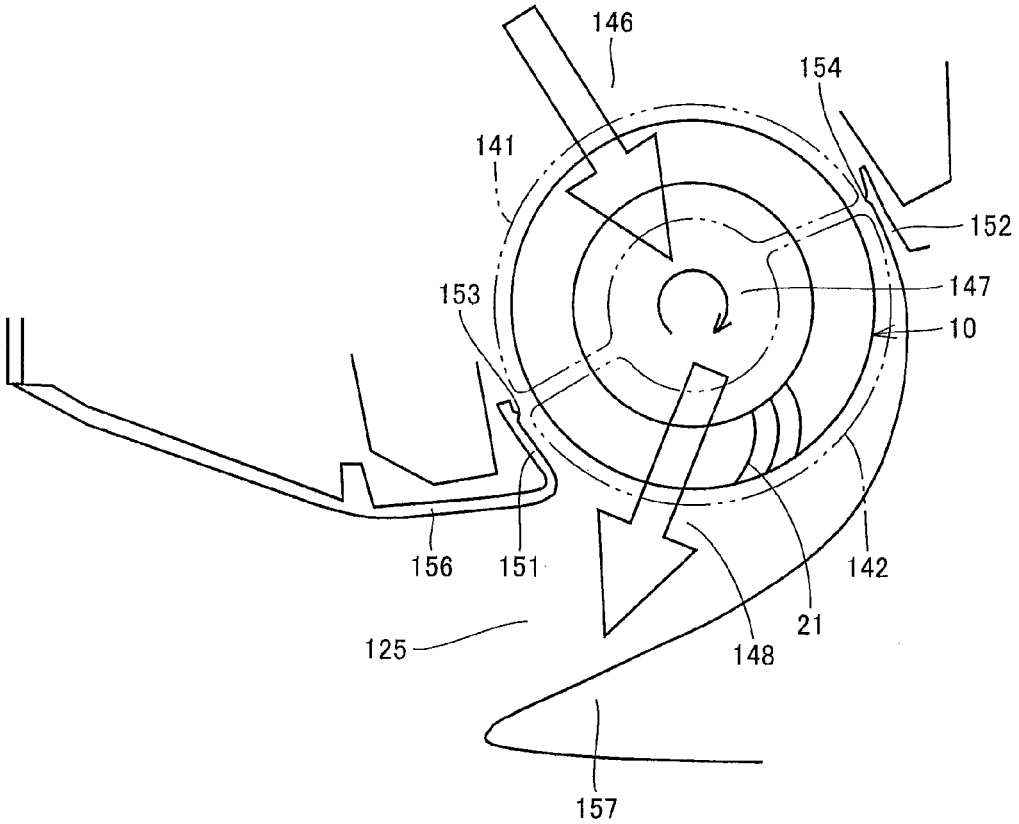
FIG. 17 is an enlarged sectional view illustrating vicinity of a blowout port in the air conditioner illustrated in FIG. 16.

FIG. 17 is an enlarged sectional view illustrating vicinity of the blowout port in the air conditioner illustrated in FIG. 16. Referring to FIGS. 16 and 17, casing 122 has a front wall portion 151 and a rear wall portion 152. Front wall portion 151 and rear wall portion 152 are disposed facing each other with an interval therebetween.

On the route of air-blow passage 126, cross-flow fan 10 is situated between front wall portion 151 and rear wall portion 152. Front wall portion 151 has a projection 153 projecting toward an outer peripheral surface of cross-flow fan 10 to minimize a space between cross-flow fan 10 and front wall portion 151. Rear wall portion 152 has a projection 154 projecting toward the outer peripheral surface of cross-flow fan 10 to minimize a space between cross-flow fan 10 and rear wall portion 152.

Casing 122 has an upper-side guiding portion 156 and a lower-side guiding portion 157. Air-blow passage 126 is regulated by upper-side guiding portion 156 and lower-side guiding portion 157 on the more downstream side of airflow than cross-flow fan 10.

Upper-side guiding portion 156 and lower-side guiding portion 157 are respectively continuous from front wall portion 151 and rear wall portion 152 and extending toward blowout port 125. Upper-side guiding portion 156 and lower-side guiding portion 157 are curved in a manner that upper-side guiding portion 156 is on the inner peripheral side and lower-side guiding portion 157 is on the outer peripheral side to thereby guide the airflow discharged by cross-flow fan 10 forward and downward. Upper-side guiding portion 156 and lower-side guiding portion 157 are formed in a manner that a cross sectional area of air-blow passage 126 increases toward blowout port 125 from cross-flow fan 10.

According to the present embodiment, front wall portion 151 and upper-side guiding portion 156 are formed to be integral with front panel 122B, and rear wall portion 152 and lower-side guiding portion 157 are formed to be integral with cabinet 122A.

Figure 18:
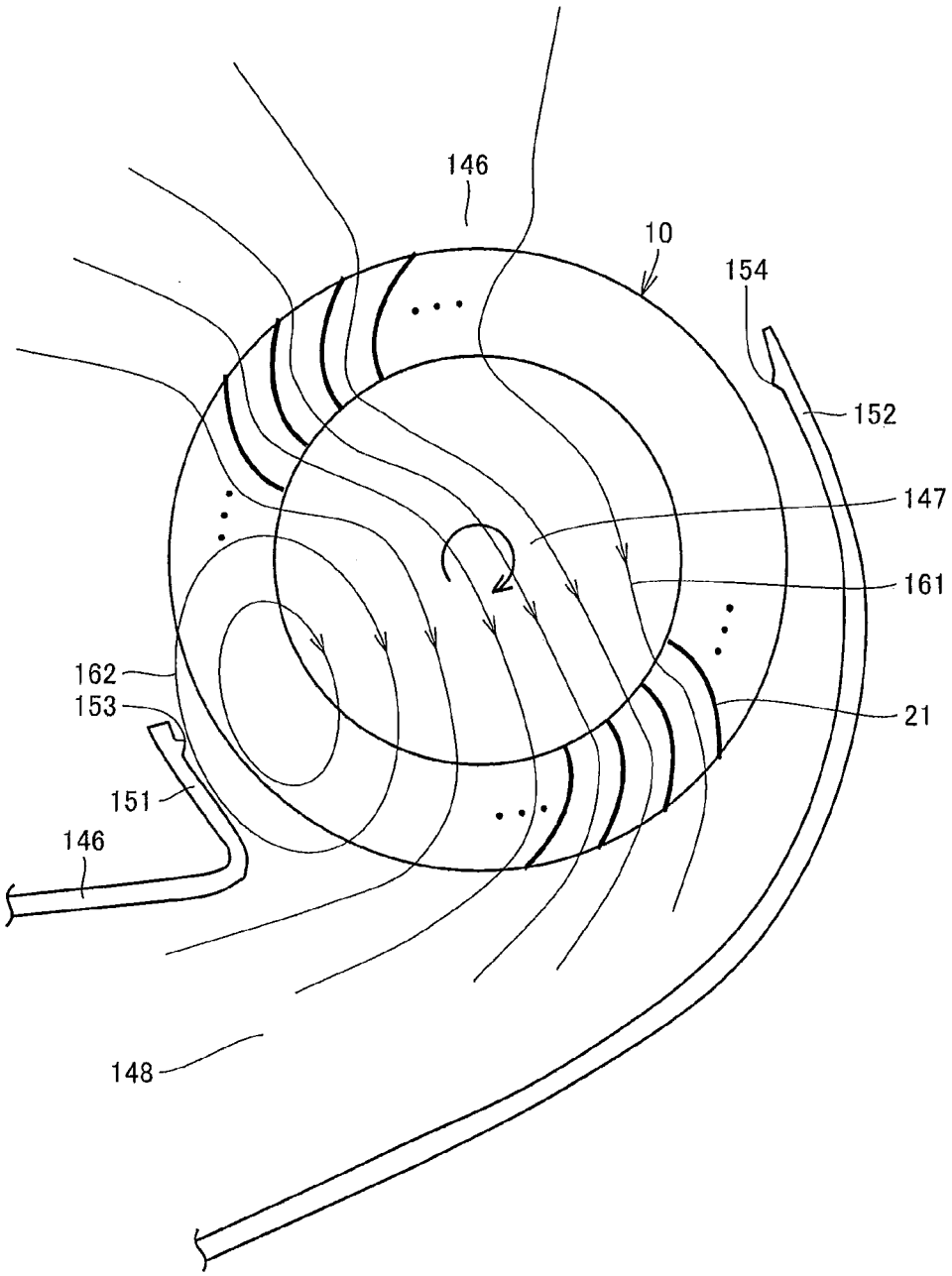
FIG. 18 is a sectional view illustrating an airflow generated in the vicinity of the blowout port in the air conditioner illustrated in FIG. 16.

FIG. 18 is a sectional view illustrating an airflow generated in vicinity of the blowout port of the air conditioner illustrated in FIG. 16. Referring to FIGS. 17 and 18, an upstream outer space 146 is formed on the more upstream side of airflow than cross-flow fan 10, an inner space 147 is formed on the inner side of cross-flow fan 10 (on the inner peripheral side of plural fan blades 21 arranged in the circumferential direction), and a downstream outer space 148 is formed on the more downstream side of airflow than cross-flow fan 10.

During the rotation of cross-flow fan 10, an airflow 161 passing through over blade surface 23 of fan blade 21 from upstream outer space 146 and directed toward inner space 147 is formed in an upstream region 141 of air-blow passage 126 defined with projections 153 and 154 as a boundary, and an airflow 161 passing through over blade surface 23 of fan blade 21 from inner space 147 and directed toward downstream outer space 148 is formed in a downstream region 142 of air-blow passage 126 defined with projections 153 and 154 as a boundary. At this time, an airflow vortex 162 is formed at a position adjacent to front wall portion 151.

The present embodiment described the cross-flow fan provided in the air conditioner. The cross-flow fan is also applicable to other devices configured to discharge fluid, for example, air purifier, humidifier, cooling device, and ventilating device.

Next, a molding die used to produce cross-flow fan 10 illustrated in FIG. 1 is described.

Figure 19:
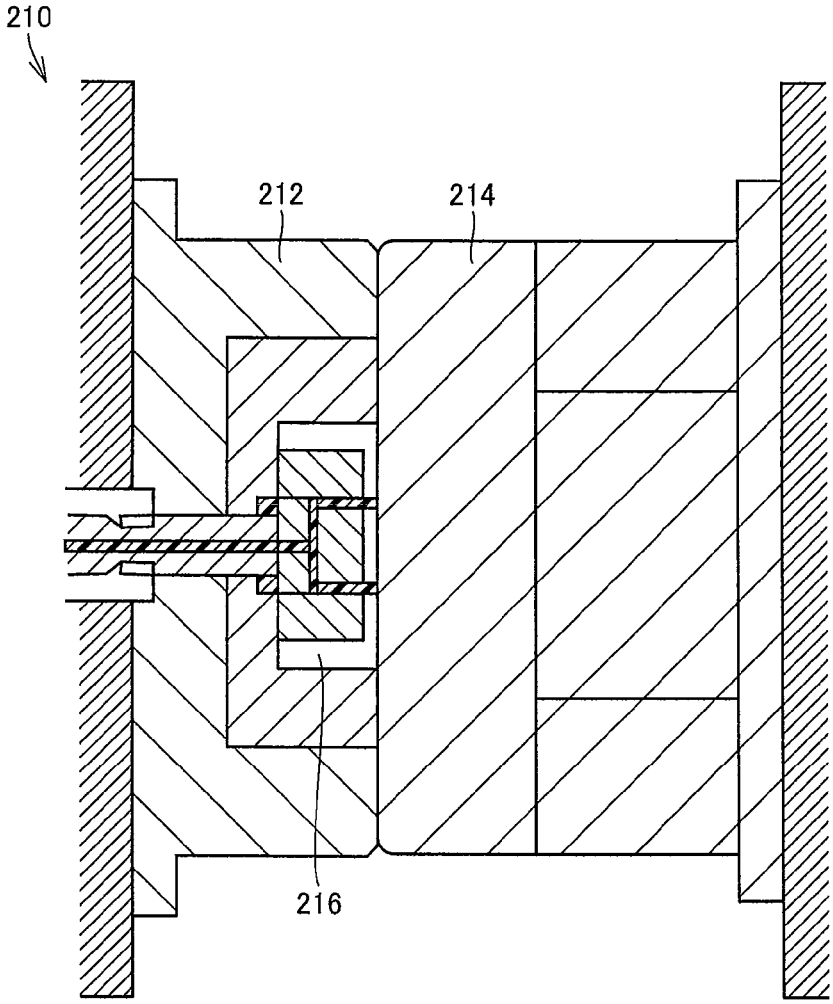
FIG. 19 is a sectional view of a molding die used to produce the cross-flow fan illustrated in FIG. 1.

FIG. 19 is a sectional view of a molding die used to produce cross-flow fan 10 illustrated in FIG. 1. Referring to FIG. 19, a molding die 210 has a fixated die 214 and a movable die 212. Fixated die 214 and movable die 212 define a cavity 216 formed in a shape substantially equal to that of cross-flow fan 10, resin having fluidity being injected in to cavity 216.

Molding die 210 may be equipped with a heater, not illustrated in the drawings, to increase the fluidity of the resin injected into cavity 216. The arrangement of the heater is useful particularly when synthetic resins having enhanced strengths, for example, glass-filled AS resin, are used.

According to air conditioner 110 thus configured, cross-flow fan 10 used as an air blower can improve quietness during the operation while maintaining a high air-blow performance. Molding die 210 thus configured can produce cross-flow fan 10 superior in quietness during the rotation by molding the material resin.

The embodiments disclosed in the specification are just examples, therefore, should be construed as not imposing any restrictions on the invention. The scope of the invention is technically defined by not the description given thus far but the appended claims, and it is intended to cover in the scope of the invention the appended claims, the meaning of equivalence, and all possible modifications as fall within the scope of this invention.

INDUSTRIAL APPLICABILITY

The present invention is mostly applied to home-use electric devices having an air-blow function such as air purifier and air conditioner.

REFERENCE SIGNS LIST

10 cross-flow fan, 12, 12A, 12B, 12C blade wheel, 13 outer peripheral frame, 13*a*, 13*b* end surface, 21 fan blade, 23 blade surface, 24 positive pressure surface, 25 negative pressure surface, 26 inner peripheral portion, 27 outer peripheral portion, 101 center axis, 106-109 straight line, 110 air conditioner, 115 air blower, 120 indoor unit, 122 casing, 122A cabinet, 122B front panel, 124 intake port, 125 blowout port, 126 air-blow passage, 128 air filter, 129 indoor heat exchanger, 131 lateral louver, 132 vertical louver, 141 upstream region, 142 downstream region, 146 upstream outer space, 147 inner space, 148 downstream outer space, 151 front wall portion, 152 rear wall portion, 153, 154 projection, 156 upper-side guiding portion, 157 lower-side guiding portion, 162 vortex, 210 molding die, 212 movable die, 214 fixated die, 216 cavity, 310 inscribed circle, 315 circumscribed circle

The invention claimed is:

1. A cross-flow fan comprising a blade wheel, the blade wheel including:

a plurality of blades arranged in a circumferential direction centered on a predefined axis with randomly different intervals therebetween; and a support unit connected to said plurality of blades to support said plurality of blades in a unified manner, wherein a plurality of said blade wheels are formed in a manner that said plurality of blades are all uniformly arranged, the plurality of said blade wheels being stacked on each other along an axial direction of said predefined axis, an inner diameter d and an outer diameter D of said plurality of blades meet a relationship expressed by $0.55 \leq d/D \leq 0.95$, N representing number of said blades, a chord length L of said plurality of blades, said outer diameter D of said plurality of blades, and M representing number the plurality of said blade wheels meet relationships expressed by $0.6 \leq L/(\pi D/N) \leq 2.8$ and $0.15 \leq \pi D/(N \times M) \leq 3.77$, and $N > 40$, the plurality of said blade wheels are stacked on each other in a manner that a displacement angle $\theta$ is generated within a range defined by $(1.2 \times 360°/(N \times M)) \leq \theta \leq (360°/N)$ between the plurality of said blade wheels adjacent to each other when viewed from the axial direction of said predefined axis, and said displacement angle $\theta$ is defined such that the overlapping number of said plurality of blades having an equal installation angle in all of said plurality of blades is greater than zero and at most 5% of $N \times M$ representing a total number of said plurality of blades, a relationship expressed by $0.05(\pi D/N) \leq |Cn-(\pi D/N)| \leq 0.24(\pi D/N)$ is met between arbitrary adjacent ones of said plurality of blades, where Cn ($n = 1, 2, \ldots, N-1, N$) is a length of a circular arc centered on said predefined axis and connecting outer peripheral ends of said plurality of blades adjacent to each other on a plane orthogonal to said predefined axis.

2. The cross-flow fan according to claim 1, wherein a relationship expressed by $0.68 \leq d/D \leq 0.86$ is further met.

3. The cross-flow fan according to claim 1, wherein a relationship expressed by $1.4 \leq L/(\pi D/N) \leq 2.1$ is further met.

4. The cross-flow fan according to claim 1, wherein a relationship expressed by $0.43 \leq \pi D/(N \times M) \leq 2.83$ is further met.

5. The cross-flow fan according to claim 1, wherein the cross-flow fan is formed from resin.

6. A molding die used to mold the cross-flow fan according to claim 5.

7. A fluid feeder comprising an air blower including the cross-flow fan according to claim 1 and a drive motor coupled with the cross-flow fan to rotate said plurality of blades.

* * * * *